US006643223B2

(12) United States Patent
Fujisawa

(10) Patent No.: US 6,643,223 B2
(45) Date of Patent: Nov. 4, 2003

(54) TIME KEEPING APPARATUS AND CONTROL METHOD THEREFOR

(75) Inventor: Teruhiko Fujisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 09/780,143

(22) Filed: Feb. 9, 2001

(65) Prior Publication Data

US 2001/0028606 A1 Oct. 11, 2001

(30) Foreign Application Priority Data

Feb. 10, 2000 (JP) ..... 2000-033809
Dec. 25, 2000 (JP) ..... 2000-393635

(51) Int. Cl.[7] ..... G04B 1/00; G04C 3/00
(52) U.S. Cl. ..... 368/204; 368/205; 307/116
(58) Field of Search ..... 368/64, 66, 203, 368/204, 205; 307/112, 116–119; 323/318

(56) References Cited

U.S. PATENT DOCUMENTS 6,320,822 B1 * 11/2001 Okeya et al. ..... 368/204
6,424,600 B1 * 7/2002 Okeya et al. ..... 368/204
6,476,580 B1 * 11/2002 Nakamiya et al. ..... 368/204
6,483,781 B2 * 11/2002 Igarashi et al. ..... 368/204
6,563,766 B1 * 5/2003 Nakamiya ..... 368/64

FOREIGN PATENT DOCUMENTS

EP 0 935 178 A2 8/1999
JP 11-223684 8/1999

* cited by examiner

*Primary Examiner*—David Martin
*Assistant Examiner*—Jeanne-Marguerite Goodwin
(74) *Attorney, Agent, or Firm*—Mark P. Watson

(57) ABSTRACT

When a time keeping apparatus is in a power saving mode, performing time display is stopped, and the apparatus periodically receives external time data and sets the data into a second time counter and an hour-and-minute time counter. When the operation mode of the time keeping apparatus is switched from the power saving mode to the display mode, the apparatus resumes display of the current time based on the counted values in the second time counter and the hour and minute time counter.

17 Claims, 15 Drawing Sheets

TIME KEEPING APPARATUS AND CONTROL METHOD THEREFOR

BACKGROUND OF THE INVENTION

1. Field of the Invention

The present invention relates to a time keeping apparatus and a control method therefor, and more particularly to a radio-controlled timepiece having a power saving function to reduce its power consumption.

2. Description of the Related Art

A radio-controlled watch that has a power saving function and receives external time data (i.e. time signals received from outside the watch) and adjusts the time is disclosed in Japanese Patent Application Laid Open Publication No. 11-223684 entitled "radio-controlled watch". The radio-controlled watch has a thermoelectric generator that generates electricity by using a temperature difference between the wearer's arm and outside air. The watch stores the electricity in its storage unit and uses the electricity to operate.

The radio-controlled watch periodically receives a standard time radio signal from the Communications Research Laboratory (CRL) of Japan that is transmitted at a frequency of 40 kHz under a call sign of JJY (its former call sign was JG2AS). In the radio wave, time data is superimposed, and one set of the time data has a length of 60 seconds. The time data has data of the current hour, current minute, and current day that shows the number of days from January first of that year. Based on the time data, the time of the watch is adjusted.

However, the radio-controlled watch has a drawback. The drawback is that when a user wears the watch that was left unused (not worn on a user's arm) for a long time, the user cannot know the correct time for several minutes. This is because the time adjustment of the watch is conducted only after the watch receives several sets of the time data. This is also because there are cases where the watch does not conduct a time adjustment, but continues to perform a time display: one such case is when the storage or storage unit voltage declines below a certain voltage where time display can become incorrect.

SUMMARY OF THE INVENTION

Accordingly, an object of the present invention is to provide a time keeping apparatus and a control method therefor, with which the user can know the current time more quickly and precisely when the operation mode of the apparatus is switched from the power saving mode to the normal operation mode.

According to one aspect of the present invention, a time keeping apparatus comprises: a generator unit that generates electricity using external energy; a storage unit that stores the electricity; a time display unit that displays time by using the electricity supplied from the storage unit; a generation state detecting unit that detects an operation state of the generator unit and that outputs a detected generation state signal; a mode switching unit that, responsive to the detected generation state signal, switches an operation mode between a normal operation mode in which the time display operation is performed, and a power saving mode in which the time display operation is stopped; a receiver unit that receives external time information in a prescribed cycle; a current time counting unit that renews current time information by referring to the time that corresponds to the time information received by the receiver unit; and a current time display switching unit that is responsive to the operation mode switching from the power saving mode to the normal operation mode to switch a state of the time display unit from a time display stoppage state to a current time display state in which a current time is displayed, based on the current time information; and wherein the mode switching unit switches the operation mode from the normal operation mode to the power saving mode when the state of the generator unit is detected in a non-generation state on the basis of the detected generation state signal.

According to another aspect of the present invention, a time keeping apparatus comprises: a generator unit that generates electricity using external energy; a storage unit that stores the electricity; a time display unit that performs a time display using the electricity supplied from the storage unit; a carry-state detecting unit that detects a carry-state of the time keeping apparatus and that outputs a detected carry-state signal; a mode switching unit that switches an operation mode of the time display unit between a normal operation mode in which the time display is performed and a power saving mode in which the time display is stopped, based on the detected carry-state signal; a receiver unit that receives external time information in a prescribed cycle; a current time counting unit that renews current time information by referring to the time that corresponds to the time information received by the receiver unit; and a current time display switching unit that is responsive to the operation mode switching from the power saving mode to the normal operation mode to switch a state of the time display unit from a time display stoppage state to a current time display state in which a current time is displayed, based on the current time information; and wherein the mode switching unit switches the operation mode from the normal operation mode to the power saving mode when the carry-state of the time keeping apparatus is detected to be in a non-carried state on the basis of the detected carry-state signal.

According to another aspect of the present invention, a method is provided for controlling a time keeping apparatus which comprises a generator unit that generates electricity by converting external energy to electrical energy and a time display unit that performs a time display, the method for controlling the time keeping apparatus comprising: detecting a state of generation of the generator unit and outputting a detected generation state signal; switching an operation mode of the time display unit between a normal operation mode in which the time display is performed and a power saving mode in which the time display is stopped, based on the detected generation state signal; receiving external time information in a predetermined cycle during the power saving mode; renewing current time information that corresponds to the current time by referring to the external time information received; and in response to the operation mode switching from the power saving mode to the normal operation mode, switching a state of the time display unit from a time display stoppage state to a current time display state in which a current time is displayed, based on the current time information; and wherein the operation mode switches from the normal operation mode to the power saving mode when the state of generation of the generator unit is detected to be in a non-generation state on the basis of the detected generation state signal.

DETAILED DESCRIPTION

[1] First Embodiment

[1.1] Configuration of the First Embodiment

Figure 1:
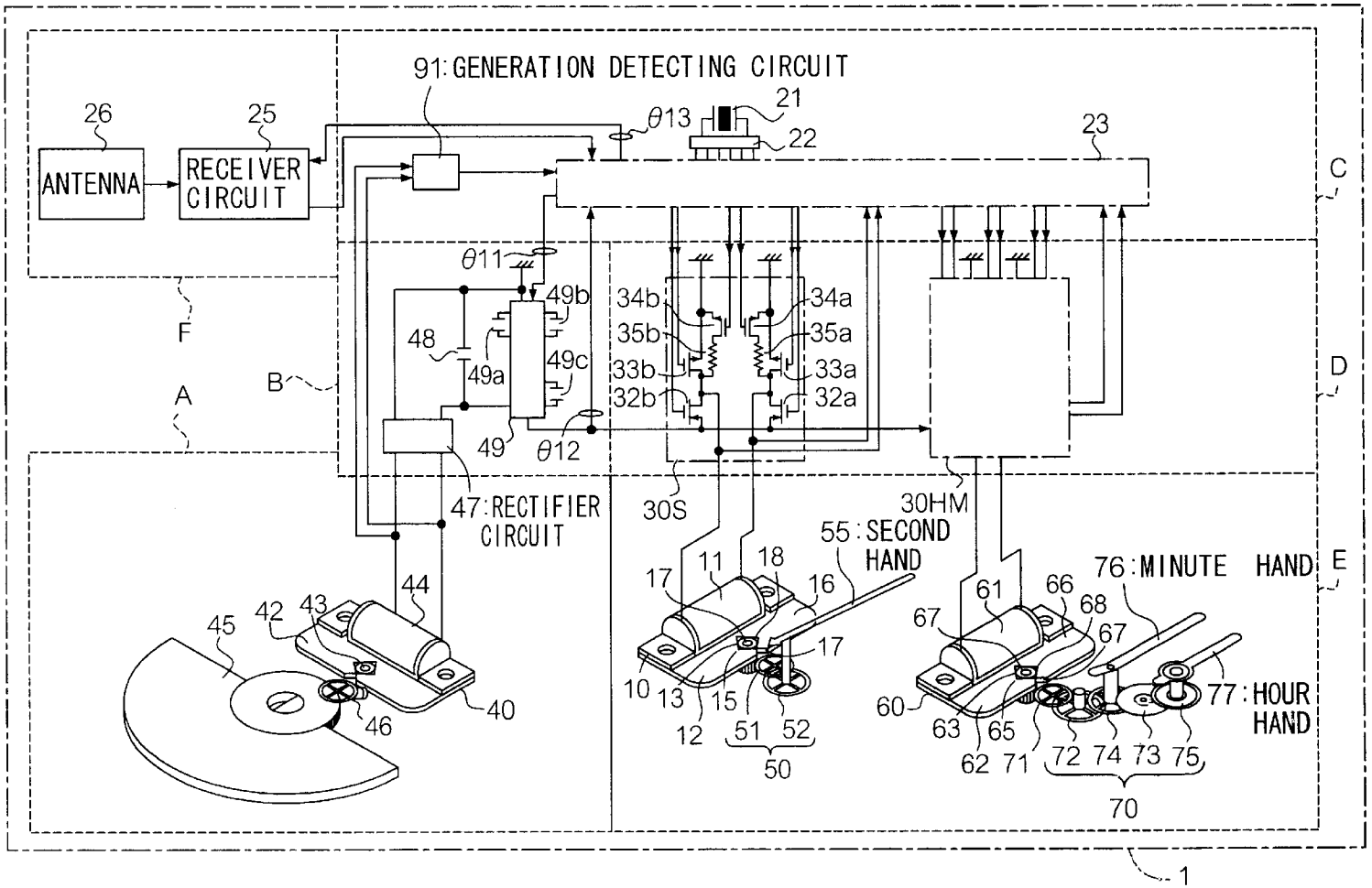
FIG. 1 is a schematic diagram of a time keeping apparatus of the present invention.

Referring to the drawings, a first embodiment of the present invention will be described. FIG. 1 is a schematic diagram of a time keeping apparatus 1 according to the first embodiment of the present invention. The apparatus 1 is a wristwatch used with a band connected to the watch body. A user winds the band around his or her own wrist.

The time keeping apparatus 1 essentially includes a power generation unit A for generating alternating current; a power source unit B for rectifying and boosting the alternating voltage from the power generation unit A, for storing the electricity, and for supplying each component with the power; a controller unit C for detecting a generation state of the power generation unit A and for controlling the apparatus based on the detected result; a hand drive mechanism E for moving hands by using an hour-and-minute motor 60 and a second motor 10; a drive unit D for driving the hand drive mechanism E based on a control signal provided from the controller unit C; and a receiver unit F for receiving an external radio wave (i.e. coming from outside the watch).

Each component of the apparatus will be described next.

[1.1.1] Configuration of a Generator Unit

The power generator unit A comprises a generating device 40, an oscillating weight 45, and a speed increasing gear 46. The generating device 40 is an electromagnetic induction type AC generator, and comprises a rotor 43, a stator 42, and a coil 44. The rotor 43 is connected via the speed increasing gear 46 to the oscillating weight 45.

The oscillating weight 45 is configured to swing in response to a user's arm motion. The kinetic energy of the oscillating weight 45 is transmitted to the rotor 43 via the speed increasing gear 46. By this action, the rotor 43 rotates in the stator 42 and a voltage is induced across the coil 44. The induced voltage is output to two output terminals of the coil 44. In this way, making use of the energy relating to the user's daily activity generates electricity. The time keeping apparatus 1 is driven with this electricity.

[1.1.2] Configuration of a Power Supply Unit

The power source unit B is essentially composed of a rectifier circuit 47, a large capacitance capacitor (or storage unit) 48, and a voltage boost and drop circuit 49. The voltage boost and drop circuit 49 uses several capacitors 49*a*, 49*b* and 49*c* to implement a multistage voltage boost and drop. By this and in response to a control signal ϕ11 given from the controller unit C, a voltage supplied to the drive unit D can be adjusted. In addition, an output voltage of the voltage boost and drop circuit 49 is supplied to the controller unit C by a monitor signal ϕ12, so the output voltage is monitored. However, instead of this configuration of supplying the output voltage of the circuit 49 to the controller unit C, another configuration of supplying a voltage signal of the capacitor or storage unit 48 to the controller unit C is possible. The power source unit B outputs voltage between its two output terminals. One terminal having a higher electrical potential Vdd is fixed to a referential electrical potential GND. The other terminal having a lower electrical potential Vss supplies a power source voltage.

[1.1.3] Configuration of a Hand Drive Mechanism

The hand drive mechanism E comprises a second motor 10 and an hour-and-minute motor 60. The second motor 10 drives a second hand 55. The hour-and-minute motor 60 drives an hour hand 77 and a minute a hand 76. As motors for the motors 60 and 10, stepping motors are used. The stepping motor is also referred to as a pulse motor, a step motor, or a digital motor, and is driven with a pulse signal and is widely used as an actuator for digital controlled apparatus. In recent years, compact and lightweight stepping motors are widely used as actuators for compact and portable electronic devices or information devices. Among these electronic devices is time keeping apparatus such as electronic clocks, electronic time switches, and chronographs.

The second motor 10 comprises a coil 11, a stator 12, and a rotor 13. Driving pulses provided from the drive unit D produce a magnetic field across the coil 11. The stator 12 has two functions, one is for affixing the motor, and the other is as an electromagnet excited by the coil 11. The rotor 13 rotates by the magnetic field in the stator 12.

The hour-and-minute motor 60 has a similar configuration to that of the second motor 10. The motor 60 comprises a coil 61, a stator 62, and a rotor 63. Driving pulses supplied from the drive unit D produce a magnetic field across the coil 61. The stator 62 has two functions, one is for affixing the motor, and the other is as an electromagnet excited by the coil 61. The rotor 63 rotates by the magnetic field in the stator 62.

Rotation of the rotor 13 is transmitted to the second hand by way of a second gear train 50 consisting of a second intermediate wheel 51 engaged with the rotor 13 via a pinion, and a second wheel 52. Attached to the shaft of the second wheel 52 is the second hand 55. Rotation of the rotor 63 is transmitted to the hour hand and the minute hand by way of a hour-and-minute gear train 70 consisting of a fourth wheel 71 engaged with the rotor 63 via a pinion, a third wheel 72, a center wheel 73, a minute wheel 74, and an hour wheel 75. The center wheel 73 is connected to a minute hand 76, and the hour wheel 75 to an hour hand 77. Hence, these hands 55, 76, and 77 display the time by the rotations of rotors 63 and 13.

[1.1.4] Configuration of a Drive Unit

The drive unit D comprises a second drive circuit 30S and an hour-and-minute drive circuit 30HM. The drive unit D provides the hour-and-minute motor 60 and the second motor 10 with various driving pulses under the control of the control unit C.

[1.1.5] Configuration of a Receiver Unit

The receiver unit F comprises a ferrite rod antenna 26, a receiver circuit 25, and a storage circuit (not shown in figures) for storing time information. The antenna 26 receives radio waves including standard time radio signal, for example JJY broadcast at a frequency of 40 kHz by the Communications Research Laboratory (CRL) of Japan. The receiver circuit 25 is tuned to receive the standard time radio signal and outputs time data. The storage circuit stores the time data.

Figure 4:
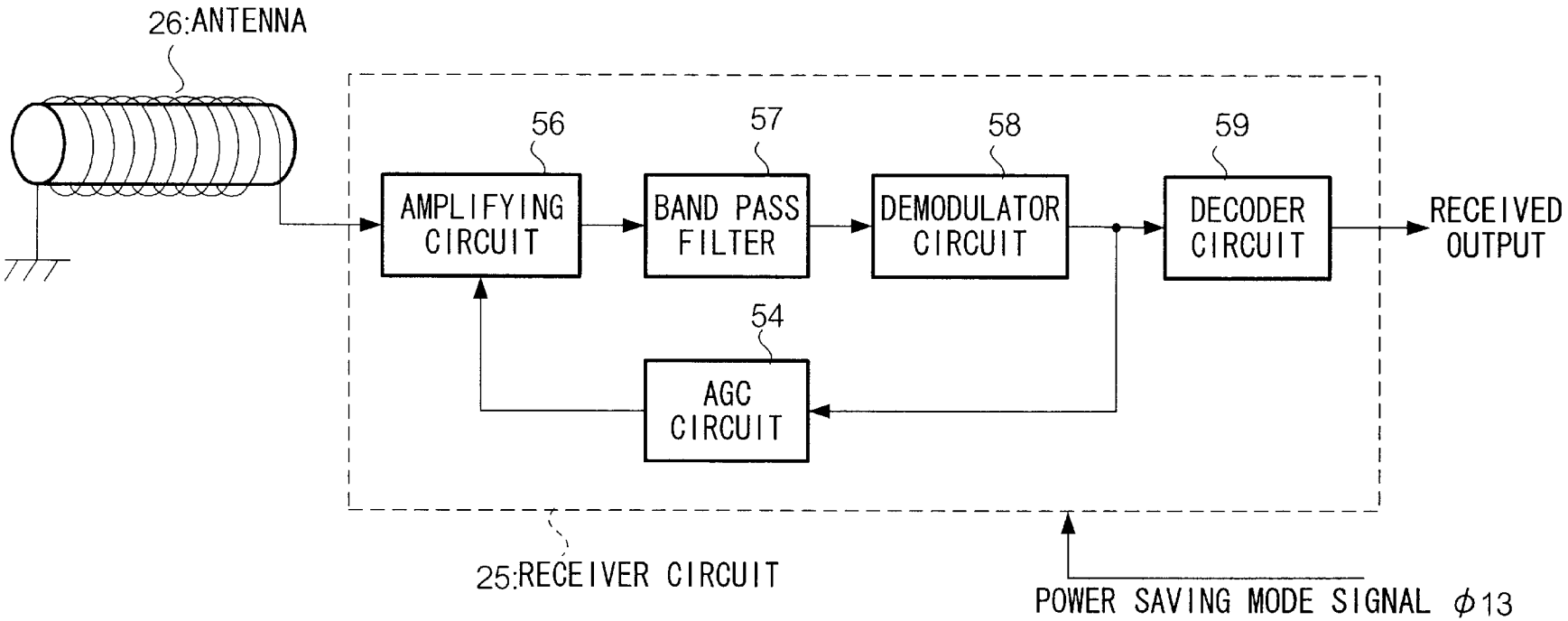
FIG. 4 is a block diagram showing a configuration of a receiver circuit.

With reference to FIG. 4, the detailed configuration of the receiver circuit 25 will be described. The receiver circuit 25 comprises an Automatic Gain Control (AGC) circuit 54, an amplifying circuit 56, a band pass filter 57, a demodulator circuit 58, and a decoder circuit 59.

The radio wave received by the antenna 26 enters the amplifying circuit 56. The amplifying circuit 56 amplifies the radio signal under a gain control by the AGC circuit 54 and outputs it to the band pass filter 57. The band pass filter 57 selects a radio signal with a target frequency from the radio wave and outputs it to the demodulator circuit 58. The demodulator circuit 58 smoothes the selected radio wave, demodulates it, and outputs it to the decoder circuit 59. The decoder circuit 59 decodes the demodulated signal and outputs it as a received output signal.

In this process, the AGC circuit 54 controls the gain of the amplifying circuit 56 based on the output signal of the demodulator circuit 58 to make the output level of the standard time radio wave constant. The power saving mode signal ϕ13 shown in FIG. 4 is supplied from a controller circuit 23 shown in FIG. 1 and controls on/off of the receiving operation of the receiver circuit 25. In more concrete explanation, when the power saving mode signal ϕ13 has a high level, the receiver circuit 25 carries out the receiving operation, and when the power saving mode signal has a low level, the receiver circuit 25 does not carry out the receiving operation, thereby lowering the power consumption of the circuit 25.

In the display mode, which corresponds to the normal operation mode, the receiver circuit 25 is controlled by the power saving mode signal ϕ13 to carry out a receiving operation in a prescribed cycle (for example in a cycle of one day). When the time data is not received correctly, the receiving operation will be carried out more than once.

In the power saving mode, the circuit 25 is controlled by the signal ϕ13 to carry out a receiving operation in another cycle (for example, in a cycle of several days), which is longer than that in the display mode. The reason is to reduce the power consumption during the power saving operation, since the receiving operation requires electric current of 30 to 40 micro amperes which is about 100 to 200 times more than that in the normal operation mode.

Figure 9:
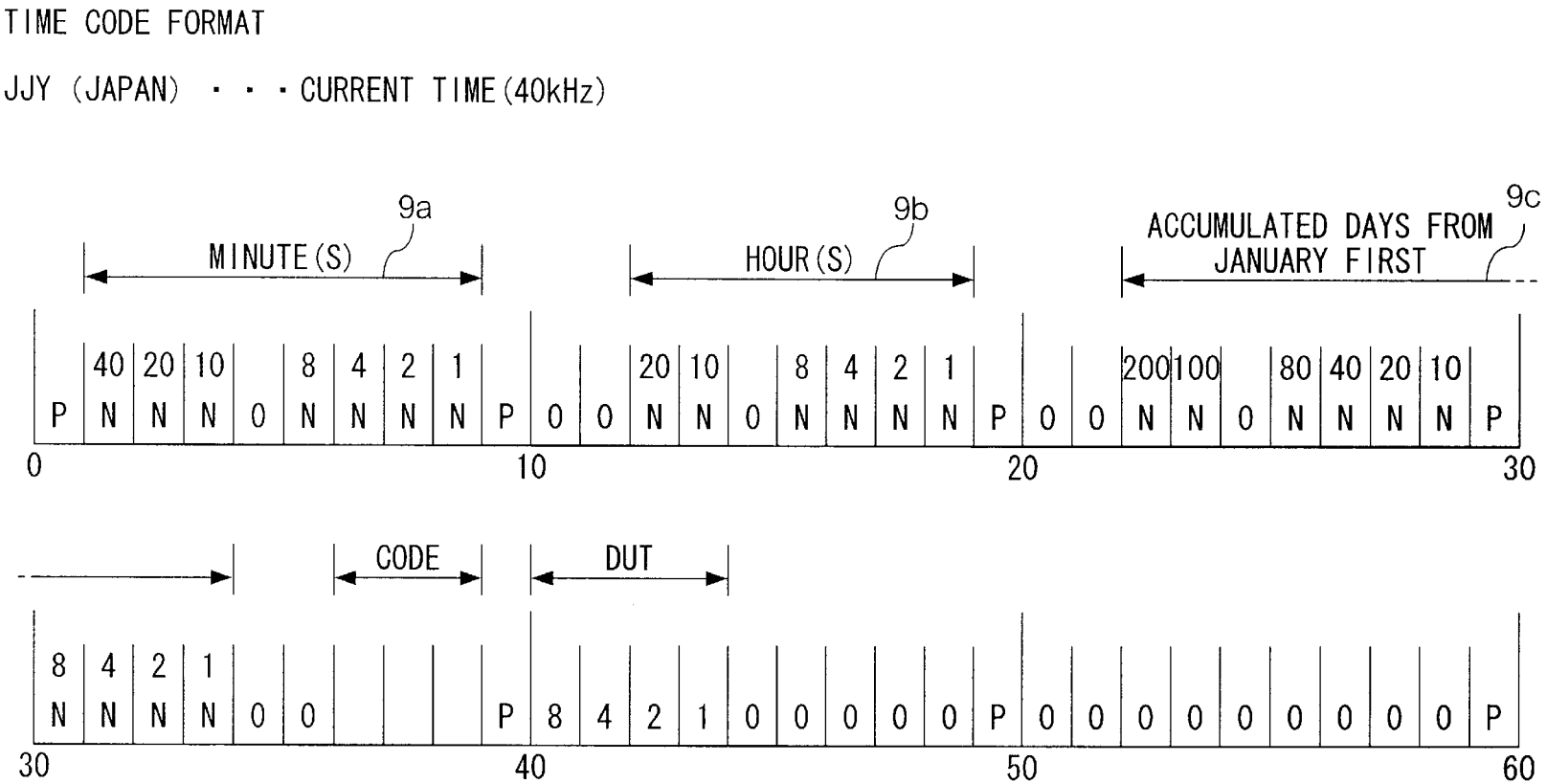
FIG. 9 shows the timecode format of the standard time radio signal by the Communications Research Laboratory (CRL) of Japan.
Figure 10:
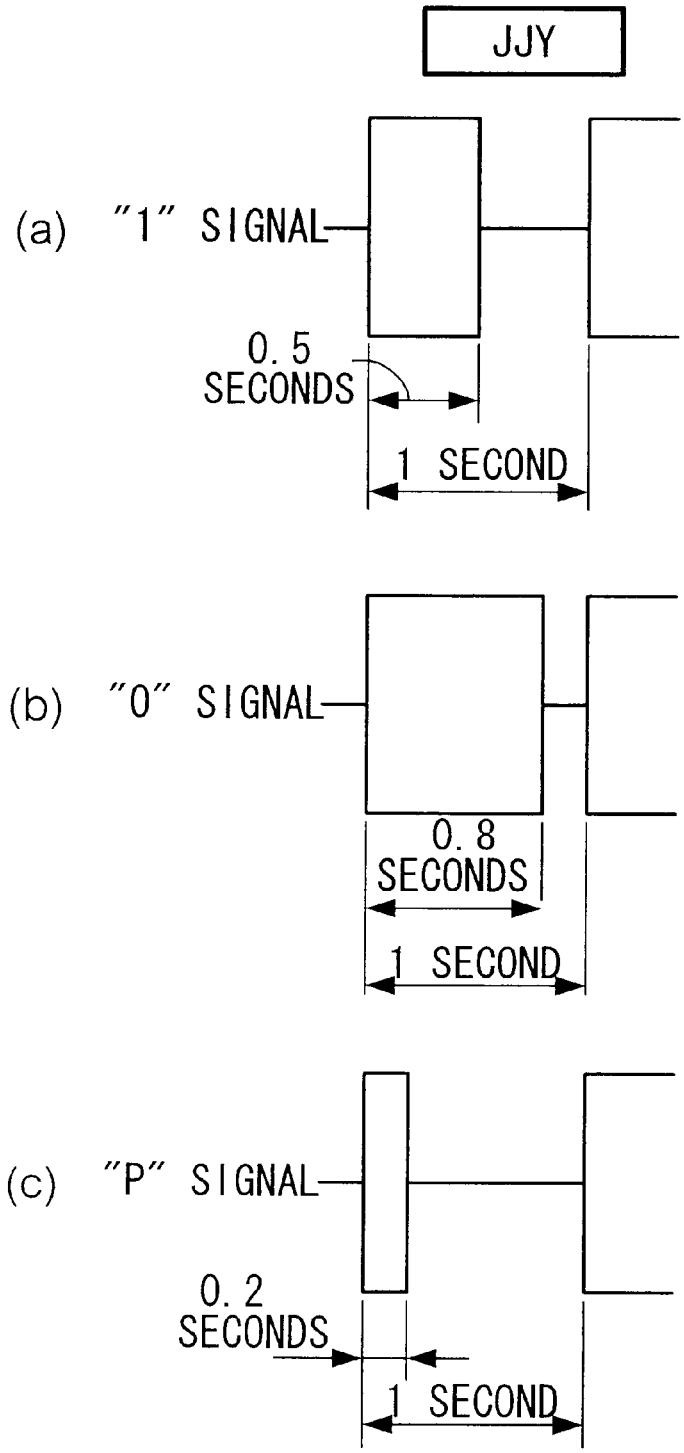
FIG. 10 is a diagram explaining the signals by the CRL.

With reference to FIGS. 9 and 10, the standard time radio signal by the CRL of Japan will be described. The standard time radio signal has incorporated time data in it with a format shown in FIG. 9. The time code format shown in FIG. 9 will be described. The time code has sixty segments. For each segment, one signal is transmitted. It takes one second to transmit one signal. Sixty signals (one minute) compose one set of time data. Each signal transmitted from the CRL has any one of three types, "1", "0", and "P".

Types of the signals are identified by the duty factor of each signal shown in FIG. 10. Part (*a*) of FIG. 10 shows a signal waveform representing "1" with large amplitude lasting 0.5 seconds (duty factor 50). Part (*b*) of FIG. 10 shows a pulse form representing "0" with large amplitude lasting 0.8 seconds (duty factor 80). Part (*c*) of FIG. 10 shows a pulse form representing "P" with large amplitude lasting 0.2 seconds (duty factor 20).

As shown in FIG. 9, the time code format includes minute information 9*a* indicating the current minute, hour information 9*b* indicating the current hour, and day information 9*c* indicating the current day. The current day is indicated as accumulated days from January first of the year.

The parameters "P" and "0" in the time code format in FIG. 9 are constant parameters and used for synchronization between the radio wave signal and the time code format. Two "P"s in a row means "00" sharp.

The indication "N" in the time code format in FIG. 9 means that when signal "1" is transmitted, the parameter "N" becomes the ON state and is used for adding a minute. When a signal other than 1 is transmitted, the parameter "N" becomes the OFF state and is not used for adding. The indication "N" has a weight as shown in FIG. 9 for adding. For example, when the minute information 9*a* has a data set of "1", "0", "1", "0", "0", "1", "1", "1", the current minute is, 40*1+20*0+10*1+8*0+4*1+2*1+1*1=57.

The standard time radio signal is based on a cesium atomic clock that has an accuracy of within one second per one hundred thousand years. Therefore the radio-controlled watch keeps time accurately.

[1.1.6] Configuration of a Controller Unit

Figure 2:
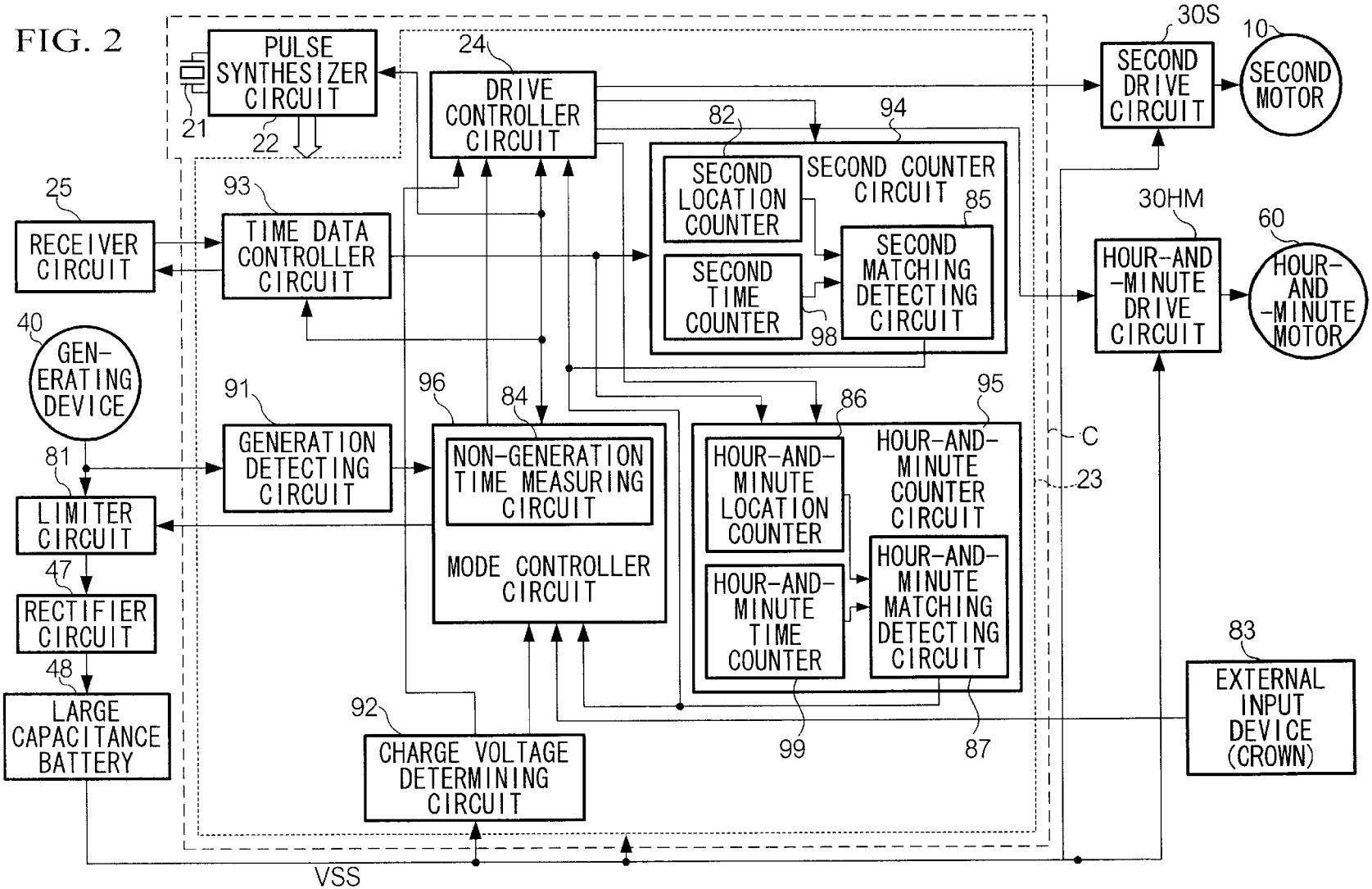
FIG. 2 is a block diagram of a controller unit.

Referring to FIG. 2, the controller unit C and its peripheral units will be described below. FIG. 2 is a functional block diagram of the controller unit C and its peripheral units of the first embodiment of the present invention. The controller unit C comprises a pulse synthesizer circuit 22, a generation detecting circuit 91, a charge voltage determining circuit 92, a time data controller circuit 93, a second counter circuit 94, an hour-and-minute counter 95, and a mode controller circuit 96.

The charge voltage determining circuit 92 determines charge voltage of the large capacitance capacitor 48. The time data controller circuit 93 controls the second counter circuit 94 and the hour-and-minute counter 95 based on the output signal of the mode controller circuit 96. The circuit 93 also controls time data receiving operation by the receiver circuit 25. Circuit 93 is not limited to a hardware configuration. The function of the circuit 93 can be achieved by software using a central processing unit (CPU), a read only memory (ROM), a random access memory (RAM), and other hardware.

Associated with the controller unit C, a limiter circuit 81 is constructed between the generating device 40 and the large capacitance capacitor 48. The limiter circuit 81 prevents the capacitor 48 from overcharging. This is because the capacitor 48 has a rated voltage. Capacitor 48 could be a battery or other type of storage unit. When the stored voltage exceeds the withstand pressure voltage, the storage unit enters a state of overcharge and the quality of the storage unit deteriorates.

When the mode controller circuit 96 is notified by the charge voltage determining circuit 92 that the voltage of the large capacitance capacitor 48 exceeds a certain voltage, the limiter circuit 81 conducts its operation by a command from the mode controller circuit 96. When the circuit 81 conducts its operation, a limiter transistor (not shown in FIG. 2) assumes the ON state and forms a by-pass in order to prevent the charging current generated by the generating device 40 from going into the storage unit 48.

However the configuration for this function is not limited to this. In this configuration, no voltage boost and drop circuit is used. However, it is possible to use the voltage boost and drop circuit. In such case, the voltage boost and drop circuit 49 in FIG. 1 can be connected to the following stage of the storage unit 48, so that the charge voltage determining circuit 92 determines the voltage boosted by the voltage boost and drop circuit 49. Also the limiter circuit 81 can be controlled by the charge voltage determining circuit 92 without using the mode controller circuit 96.

Each component of the controller unit C will be described below.

[1.1.6.1] Configuration of a Pulse Synthesizer Circuit

The pulse synthesizer circuit 22 will be described first. The circuit 22 comprises an oscillator circuit and a synthesizer circuit. The oscillator circuit is connected to a standard oscillation source 21 such as a quartz oscillator and outputs a standard pulse that has a constant frequency to the synthesizer circuit. The synthesizer circuit divides the frequency of the standard pulse and synthesizes the divided pulses and the standard pulse to generate pulse signals with various waveforms.

[1.1.6.2] Configuration of a Generation Detecting Circuit

Figure 5:
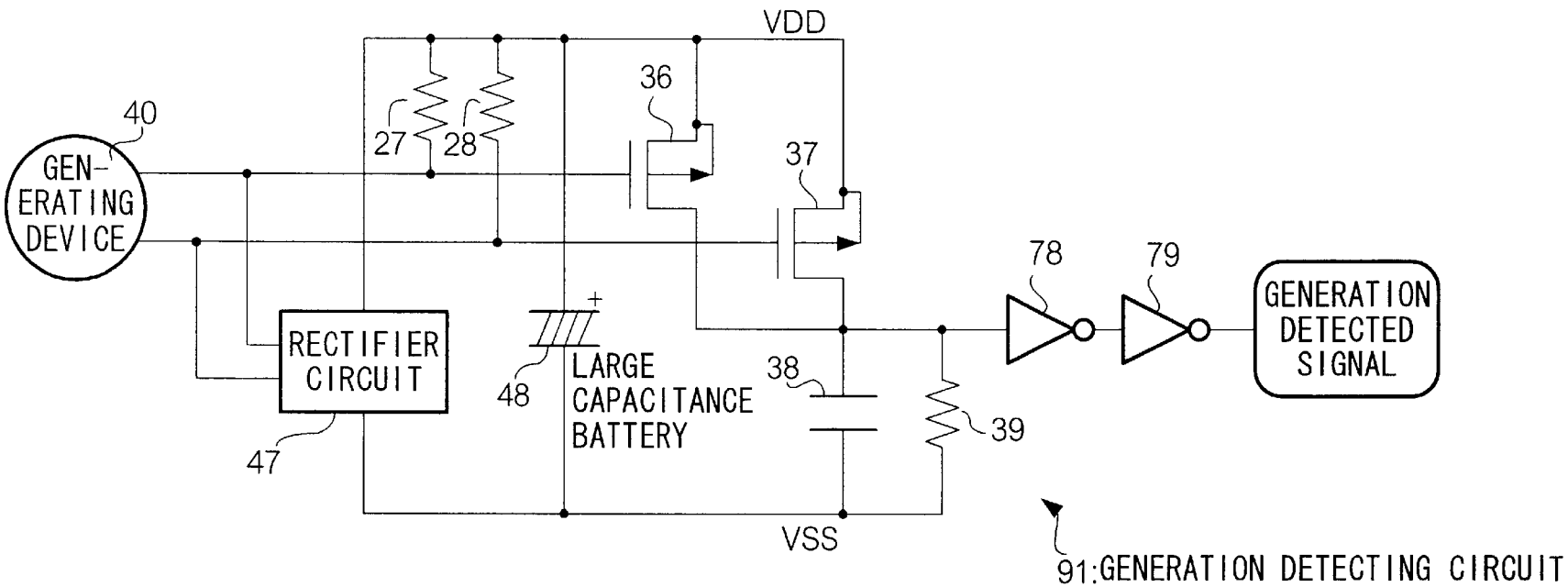
FIG. 5 is a block diagram showing a configuration of a generation detecting circuit.

With reference to FIG. 5, a detailed configuration of the generation detecting circuit 91 for outputting a detected generation signal will be described. The circuit 91 shown in FIG. 5 comprises two p-channel transistors 36 and 37, a capacitor 38, a resistor 39, two inverters 78 and 79, and two pull-up resistors 27 and 28. The gate terminal of the p-channel transistor 36 is connected to one of the output terminals of the generating device 40. The gate terminal of the transistor 37 is connected to another output terminal of the device 40. The source terminals of the transistors 36 and 37 are connected to the higher electric potential side voltage Vdd line. One terminal of the capacitor 38 is connected to the drain terminals of the transistors 36 and 37. The other terminal of the capacitor 38 is connected to the lower electric potential side voltage Vss line. The resistor 39 has high resistance ranging from several tens of million ohms to several giga ohms. The resistor 39 is connected in parallel with the capacitor 38 and is used for discharging the charge in the capacitor 38. The input terminal of the inverter 78 is connected to the drain terminals of the p-channel transistors 36 and 37. The output of the inverter 78 is connected to the inverter 79. The inverter 79 outputs a detected generation signal. In this explanation, the higher electric potential side voltage Vdd (=GND) is used as a reference voltage, and the voltage Vss represents a potential difference from the voltage Vdd, and has a negative voltage.

In the above configuration, when the generating device 40 generates voltage, the p-channel transistors 36 and 37 alternately assume the ON state and voltage is applied between both terminals of the capacitor 38 via either transistor 36 or 37. Thus, the input to the inverter 78 becomes the high level, and the detected generation signal output from the inverter 79 becomes the high level.

When the generating device 40 does not generate voltage, both the transistors 36 and 37 remain in the OFF state. Thus, the electrical charge in the capacitor 38 is discharged by the resistor 39, so the voltage between the terminals of the capacitor 38 declines and the input to the inverter 78 becomes the low level. Therefore, the detected generation signal output from the inverter 79 becomes the low level. In this configuration, the generation detecting circuit 91 has two pull-up resistors 27 and 28. Therefore, when no generation occurs in the generating device 40, it is possible to securely force the p-channel transistors 36 and 37 to the OFF state without influence of residual field. So, the power consumption by the generation detecting circuit 91 is reduced to zero. As a result, power consumption from the large capacitance capacitor 48 will be reduced.

[1.1.6.3] Configuration of a Mode Controller Circuit

The mode controller circuit 96 comprises a non-generation time measuring circuit 84. The circuit 84 controls switching of an operation mode including a display mode and a power saving mode for the time display based on the generation state, and measures a non-generation time interval Tn in which no generation is detected by the generation detecting circuit 91. The operation mode of the embodiments of the present invention has a display mode and a power saving mode. The display mode is an operation mode to continuously display time in the case of time keeping apparatus 1 of the present invention.

The power saving mode is a mode for power saving. In the power saving mode, a state of the normal operation mode just before transition to the power saving mode or a progress information of the power saving mode is stored. As a result, when switching to the normal operation mode is carried out, by using the state at the transition to the power saving mode and the progress information, transition is conducted. Therefore, in the time keeping apparatus 1 of the present invention, performing a time display is stopped, and by using the progress time in the power saving mode, when switching to the normal operation mode, correct time display can be achieved.

The mode controller circuit 96 remembers the set operation mode, and provides this information to a drive controller circuit 24 and the time data controller circuit 93. When the operation mode is changed from the display mode to the power saving mode, the drive controller circuit 24 stops supplying pulse signals to the drive circuits 30HM and 30S to stop the circuits 30HM and 30S. Then the hour-and-minute motor 60 and second motor 10 stop moving, so the hour hand, the minute hand, and the second hand stop too. Hence time display is stopped.

The user can do this manually. When the user of the watch uses a crown to perform a switching operation to the power saving mode, the mode controller circuit 96 switches the operation mode from the display mode to the power saving mode. Thus, regardless of the non-generation time Tn, it is possible to switch the operation mode to the power saving mode and to prevent the amount of the stored energy in the storage unit from declining.

The non-generation time measuring circuit 84 switches the operation mode from the display mode to the power saving mode when non-generation time Tn exceeds a given period of time. The switch from the power saving mode to the display mode is performed when the generation detecting circuit 91 detects that the generating device 40 is in the generating state, and the charge voltage determining circuit 92 determines that the voltage of the storage unit 48 is sufficient.

[1.1.6.4] Configuration of a Second Counter Circuit

The second counter circuit 94 comprises a second location counter 82, a second time counter 98, and a second matching detecting circuit 85. The second location counter 82 makes one rotation in 60 seconds. When switching from the display mode to the power saving mode, the circuit 82 drives the second hand until the second location counter 82 becomes "00" (corresponding to the location of "00" second, for example). Then when the second location counter 82 becomes "00", the counter 82 stops the time display and the operation mode is switched to the power saving mode. This is because the watch cannot determine the location of the hand, and the watch determines the relative location of the hand at the transition to the display mode by referring to the hand location corresponding to "00" count of the counter 82.

The second time counter 98 makes one rotation in 60 seconds. The counter 98 continues to count irrespective of the operation mode. When the receiver circuit 25 receives the time data, a counter value in the second time counter 98 is set based on the time data by the time data controller circuit. When the operation mode is switched from the power saving mode to the display mode, the second counter circuit 94 counts fast-forward pulses supplied from the drive controller circuit 24 to the second drive circuit 30S by using the second location counter 82. When the counted value of the second location counter 82 matches the counted value of the second time counter 98, the second matching detecting circuit 85 generates a control signal to stop sending the fast-forward pulses and supplies the signal to the second drive circuit 30S.

[1.1.6.5] Configuration of an Hour-and-Minute Counter Circuit

The hour-and-minute counter 95 comprises an hour-and-minute location counter 86, an hour-and-minute time counter 99, and an hour-and-minute matching detecting circuit 87. The hour-and-minute location counter 86 makes one rotation in 24 hours. In analog watches for example, when switching from the display mode to the power saving mode, the hour-and-minute location counter 86 drives the hands until the counter reaches to "00:00" or "12:00" (for example, corresponding to the location of 12 o'clock). When the hour-and-minute counter 86 reaches to "00:00" or "12:00", the counter 86 stops the time display and the operation mode is switched to the power saving mode. This is because the watch cannot determine the location of the hands, and the watch determines relative locations of the hands by referring to the location of hands corresponding to "00:00" or "12:00" count of the counter 86.

The hour-and-minute time counter 99 makes one rotation in 24 hours. The counter 99 continues to count irrespective of the operation mode. When the receiver circuit 25 receives the time data, a counter value in the hour-and minute time counter 98 is set based on the time data by the time data controller circuit. When the operation mode is switched from the power saving mode to the display mode, the hour-and-minute counter circuit 95 counts fast-forward pulses supplied from the drive controller circuit 24 to the hour-and-minute drive circuit 30HM by using the hour-and-minute location counter 86. When the counted value of the hour-and-minute location counter 86 matches the counted value of the hour-and-minute time counter 99, the hour-and-minute matching detecting circuit 87 generates a control signal to stop sending the fast-forward pulses and supplies the signal to the hour-and-minute drive circuit 30HM.

[1.1.6.6] Configuration of a Drive Controller Circuit

Based on various pulse signals output from the pulse synthesizer circuit 22, the drive controller circuit 24 generates drive pulse signals corresponding to the operation mode. First, when the operation mode is the power saving mode, the drive controller circuit 24 stops supplying drive pulse signals, resulting in stopping the drive motor. This reduces much of the power consumption of the apparatus, because about 85 percent of power consumption of the analog watch is due to the drive motor. Next, just after the operation mode is switched from the power saving mode to the display mode, the drive controller circuit 24 supplies fast-forward pulses having short pulse width to the drive circuit 30HM and 30S in order to make the redisplayed time adjusted. After finishing supplying fast-forward pulses, the circuit 24 supplies normal pulse width drive pulse signal to the circuit 30HM and 30S.

[1.2] Operation of the First Embodiment

Figure 3:
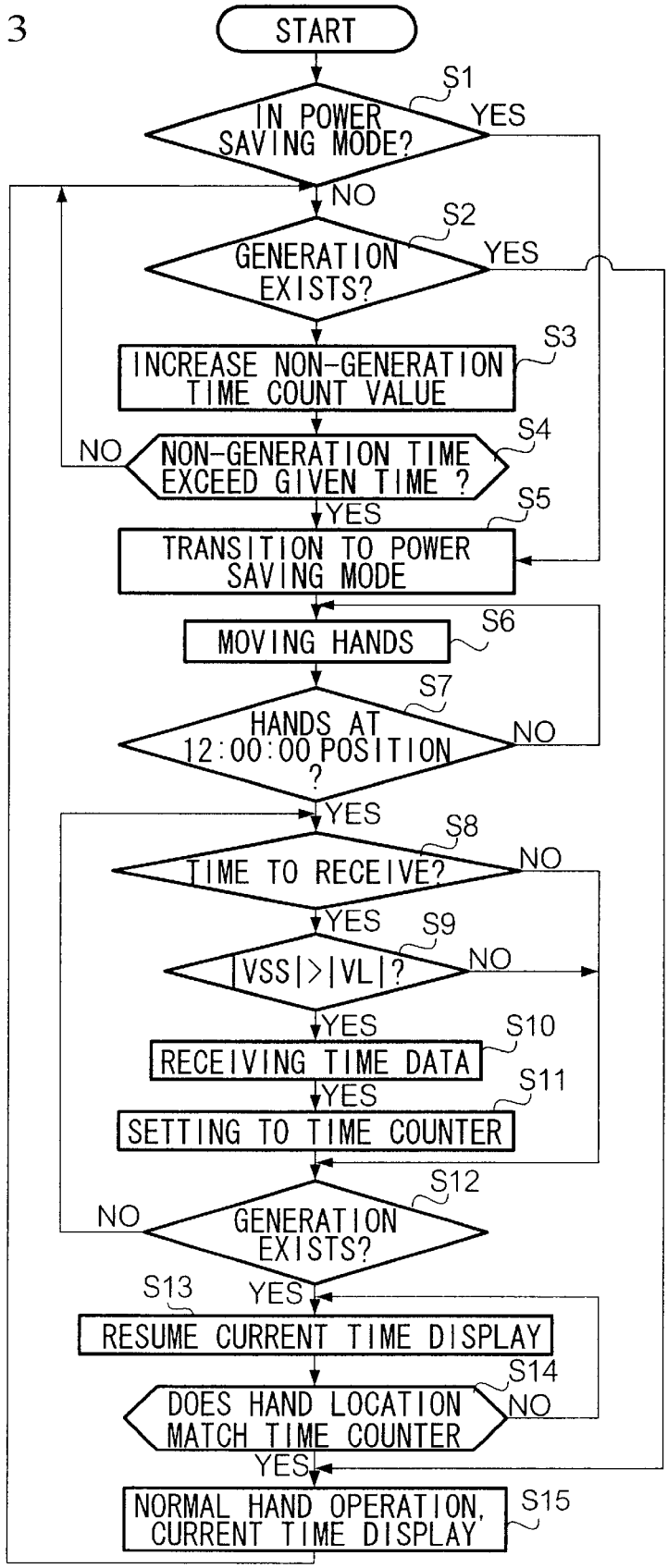
FIG. 3 is a flowchart showing an operation of the first embodiment of the present invention.

With reference to the flowchart in FIG. 3, the operation of the first embodiment of the present invention will be described by dividing it into the following three stages:

operation during the display mode;

operation during the power saving mode and during the transition from the display mode to the power saving mode; and operation during the transition from the power saving mode to the display mode.

[1.2.1] Operation During the Display Mode

First in the flowchart, the drive controller circuit 24 judges if the current operation mode set by the mode controller circuit 96 is the power saving mode (step S1). In this explanation, the operation mode is the display mode (step S1; NO), so the generation detecting circuit 91 determines the amount of generation by the generating device 40 and judges whether or not the state of the generating device 40 is in the generating state (step S2). In the judgment at the step S2, when the generation detecting circuit 91 judges that the generating device 40 is in the generating state (step S2; YES), the process of the flowchart proceeds to the step S15. The normal hand movement is conducted, and the current time display is continued (step S15). Then, the process is returned to the step S2, and the process of the flowchart continues.

[1.2.2] Operation During the Power Saving Mode and During the Transition from the Display Mode to the Power Saving Mode In the display mode, the processes of the step S2 and S15 is repeatedly conducted. Only when the non-generation time exceeds a prescribed time does the operation mode switch from the display mode to the power saving mode. Therefore, at the step S2, when the generation detecting circuit 91 judges that the generating device 40 is in the non-generation state (step S2; NO), the non-generation time measuring circuit 84 increases the counted value which is a value counted during the non-generation state (step S3). Next, the mode controller circuit 96 makes a judgment whether or not the counted value by the non-generation time measuring circuit 84 exceeds a prescribed value that corresponds to a prescribed non-generation time (step S4). When the answer is no, the process of the flowchart goes on to the step S2.

On the other hand, at the step S4, when the mode controller circuit 96 judges that the counted value by the non-generation time measuring circuit 84 exceeds a prescribed value that corresponds to a prescribed non-generation time (step S4; YES), the mode controller circuit 96 switches the operation mode from the display mode to the power saving mode, and sends to the drive controller circuit 24 a power saving mode signal which indicates that the operation mode is the power saving mode (step S5).

Then, the drive controller circuit 24 continues driving the hands until the counted values of the hour-and-minute location counter 86 and second location counter 82 reach, for example, a counted value that correspond to hands locations of 12:00:00 (step S6). The time data controller circuit 93 makes a judgment if the counted values of the counters 82 and 86 are values corresponding to the hand locations of 12:00:00 (step S7).

At the step S7, when the time data controller circuit 93 judges that the counted values have values corresponding to other than 12:00:00 (step S7; NO), the process of the flowchart goes back to the step S6.

On the other hand, at the step S7, the time data controller circuit 93 makes a judgment that the counted values have values corresponding to the hand location of 12:00:00 (step S7; YES), the operation mode is switched to the power saving mode. Next, the circuit 93 makes a judgment if it is a time to start to receive the time data (step S8). At the step S8, when the circuit 93 makes a judgment that it is not the time to start to receive the time data (step S8; NO), the process of the flowchart goes on the step S12.

On the other hand, at the step S8, when the time data controller circuit 93 makes a judgment that it is a time to start to receive the time data (step S8; YES), the charge voltage detecting circuit 92 makes a judgment if the voltage Vss exceeds a lower limit voltage VL by which receiving the time data becomes possible (step S9). When the judgment of the step S9 is NO, process of the flowchart goes on to the step S12.

On the other hand, when the judgment of the step S9 is YES, the receiver circuit 25 receives the time data through the antenna 26 and sends the time data to the time data controller circuit 93 (step S10). The circuit 93 then adjusts the counted values of the counters 98 and 99 to the current time based on the time data (step S11).

Next, the generation detecting circuit 91 determines the amount of the generation of the generating device 40, and judges if the state of the device 40 is in the generating state (step S12). In the power saving mode, at the step S12, the circuit 91 judges that the state of the device 40 is in the non-generating state (step S12; NO), the process of the flowchart returns to the step S8. Then during the power saving mode, as shown in the flowchart, when the time comes to receive the time data, the voltage Vss is checked to determine if it is high enough to receive the time data. Then when the voltage Vss is high enough, receiving the time data is conducted (step S10), and adjusting the time counter to the current time is conducted (step S11). These operations are carried out repeatedly until the transition to the display mode.

[1.2.3] Operation During Transition from the Power Saving Mode to the Display Mode Transition from the power saving mode to the display mode is carried out when a prescribed generation is occurring. Therefore, at the transition from the power saving mode to the display mode, the generation detecting circuit 91 judges that the state of the generating device 40 is in the generating state (step S12; YES). The time data controller circuit 93 starts a transition operation from the power saving mode to the display mode (step S13).

In a more concrete explanation of the transition to the display mode, the second counter circuit 94 counts the fast-forward pulses supplied from the drive controller circuit 24 to the second drive circuit 30S by using the second location counter 82. When the counted value of the second location counter 82 matches the counted values of the second time counter 98, the second matching detecting circuit 85 generates a control signal to stop sending fast-forward pulses. By supplying the control signal to the second drive circuit 30S, the second hand is adjusted to the current time (step S13 and S14).

The hour-and-minute counter circuit 95 counts the fast-forward pulses supplied from the drive controller circuit 24 to the hour-and-minute drive circuit 30HM by using the hour-and-minute location counter 86. When the counted value of the hour-and-minute location counter 86 matches the counted value of the hour-and-minute time counter 99, the hour-and-minute matching detecting circuit 87 generates a control signal to stop sending fast-forward pulses. By supplying the control signal to the hour-and-minute drive circuit 30HM, the hour hand and the minute hand is adjusted to the current time (step S13 and S14).

In this explanation, when switching to the display mode, the second hand is adjusted first, and then other hands are adjusted. However, this order is not so limited. The hour hand and the minute hand can be adjusted first. Or, the hour hand, the minute hand, and the second hand can be adjusted simultaneously. Then after the transition to the display mode that displays the current time, the normal hand movement is carried out and displaying the current time is continued (step S15).

[1.3] Modifications of the First Embodiment

[1.3.1] First Modification

In the first embodiment of the present invention, when switching to the power saving mode, the hands are allowed to move to the positions corresponding to "12:00:00" and then the hands are stopped. However, there is no requirement that the positions of the hands stop at "12:00:00"; other times are possible. In other words, if the current positions of the hands matches the counted values of the second location counter 82 and the hour-and-minute location counter 86, and if by changing the counted values of the second location counter 82 and the hour-and-minute location counter 86 the hands can be adjusted correctly, it is not necessary to limit the hand positions to "12:00:00".

[1.3.2] Second Modification

In the first embodiment of the present invention, when switching from the display mode to the power saving mode, the location of the hands are allowed to move to the positions corresponding to "12:00:00" and then the transition is carried out. However, when switching from the display mode to the power saving mode, it is possible to use other configurations in which the counted values of the second location counter 82 and the hour-and-minute location counter 86, both values corresponding to the hands location at the time of transition, are stored in nonvolatile memory or other storage means, and then transition to the power saving mode is carried out. In this case, when switching from the power saving mode to the display mode, the counted values stored in the non-volatile memory or other storage means are read out, then the values are set to the second location counter 82 and the hour-and-minute location counter 86, and by using the set values as a reference, the transition to current time display is carried out. In this way, counted values of the second location counter 82 and the hour-and-minute location counter 86 are stored in non-volatile memory, so stopping the hands can be conducted immediately. So there is no need to continue to move the hands to the position of "12:00:00" as in the first embodiment of the invention. Hence the power consumption can be further reduced.

[1.4] Effect of the First Embodiment

As explained above, by the first embodiment of the present invention, even during the power saving mode, the time data is periodically received and is set to the counted values of the hour-and-minute time counter 99 and the second time counter 98. So when switching from the power saving mode to the display mode, it is possible to display the correct time without receiving the time data yet again.

[2] Second Embodiment

In contrast to the first embodiment of the present invention, in which the actual location of the hands is not determined, a second embodiment of the present invention has a mechanism by which actual locations of the hands are determined in order to perform a current time display correctly when switching from the power saving mode to the display mode.

[2.1] Configuration of the Second Embodiment

Figure 6:
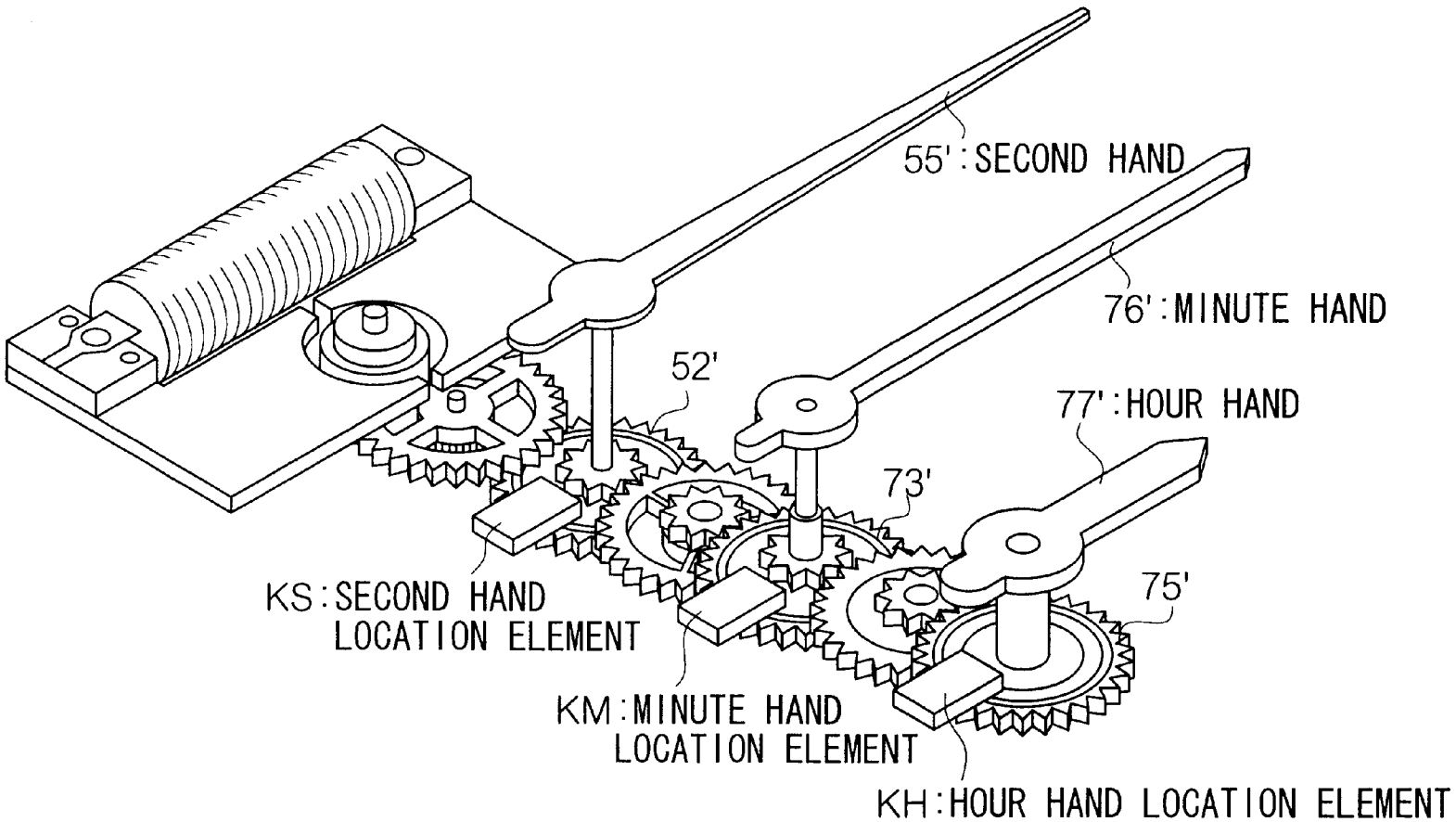
FIG. 6 shows a configuration of a hand-location determining element of the second embodiment of the present invention.

FIG. 6 shows a configuration of a hand location determining element assembled in the hand movement mechanism of the time keeping apparatus of the second embodiment of the present invention. For the sake of easy understanding of the configuration of the hand location determining element, in FIG. 6, the hour hand, the minute hand, and the second hand are configured to be driven by one drive motor. The time keeping apparatus of the second embodiment of the present invention has the same configuration as the first embodiment shown in FIGS. 1 and 2 except that the second embodiment has a second hand location element KS, a minute hand location element KM, and an hour hand location element KH.

The second hand location element KS identifies the location of the second hand by checking a magnetic substance placed on the cogs of the second wheel 52' using a hall element or other device having a similar function. In this configuration, the magnetic substance is magnetized in a prescribed magnetic information pattern. The minute hand location element KM, and the hour hand location element KH perform the same operation for their respective hands. By these operations, when switching the operation mode from the display mode to the power saving mode, it is possible to stop the hand regardless of their location at the moment of transition; hence power consumption can be further reduced.

[2.2] Operation of the Second Embodiment

In the first embodiment of the present invention, when switching from the display mode to the power saving mode, the transition is carried out after the hands reach the point of "12:00:00". Further, when switching from the power saving mode to the display mode, the transition to the current time display is carried out on the basis that the hands are on the "12:00:00" position. On the other hand, in the second embodiment of the present invention, when switching from the display mode to the power saving mode, transition is carried out regardless of the hand locations at the moment of transition. After switching from the power saving mode to the display mode, the transition to the current time display is based on the hand locations as identified by the second hand location element KS, the minute hand location element KM, and the hour hand location element KH.

With reference to the flowchart shown in FIG. 7, the operation of the second embodiment of the present invention will be described by dividing it into the following three stages:

operation during the display mode;

operation during the power saving mode and during the transition from the display mode to the power saving mode; and operation during the transition from the power saving mode to the display mode.

[2.2.1] Operation During the Display Mode

Figure 7:
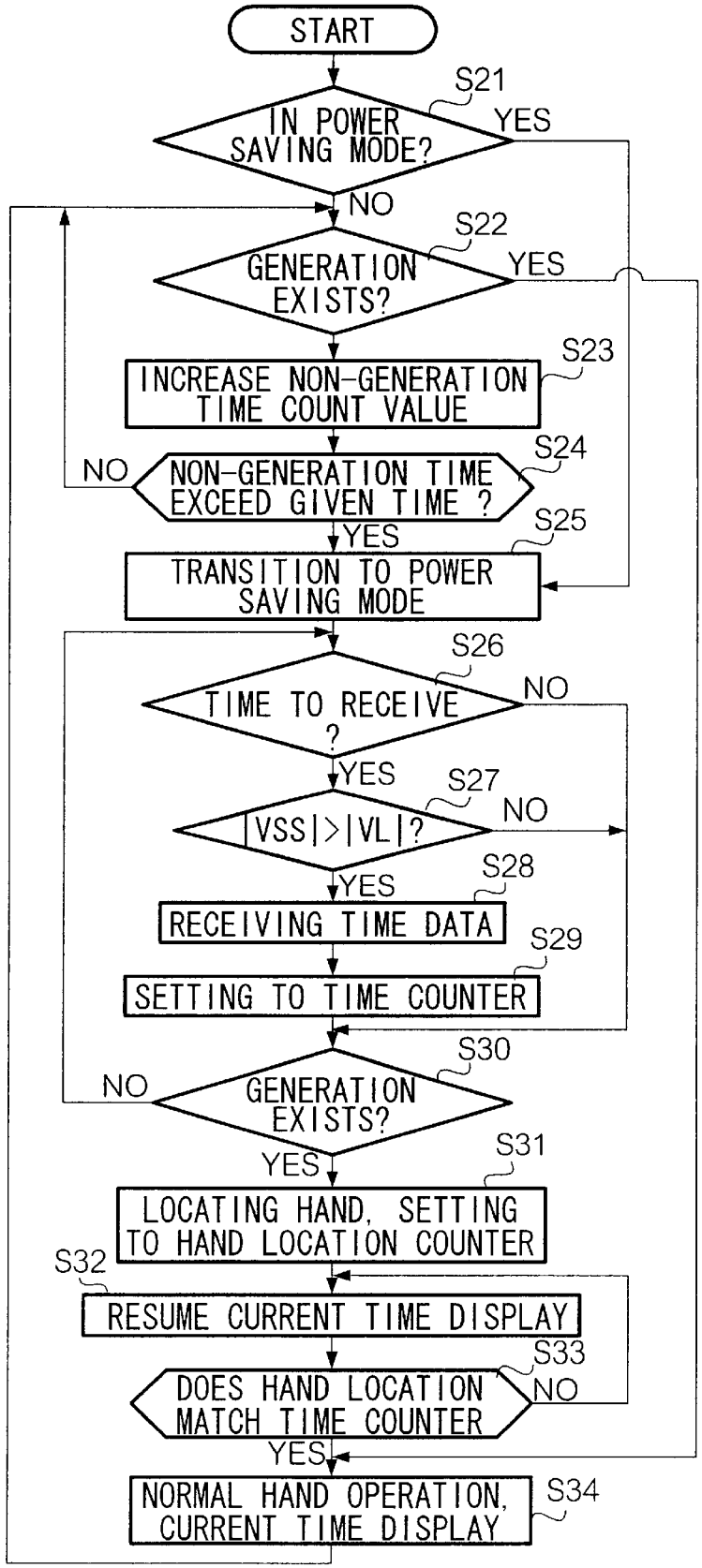
FIG. 7 is a flowchart showing an operation of the second embodiment of the present invention.

First in the flowchart of FIG. 7, the time data controller circuit 93 makes a judgment if the current operation mode set by the mode controller circuit 96 is the power saving mode (step S21). In this explanation, the operation mode is the display mode (step S21; NO), so the generation detecting circuit 91 measures the amount of generation by the generating device 40 and judges whether or not the state of the generating device 40 is in the generating state (step S22). In the judgment at the step S22, when the generation detecting circuit 91 judges that the generating device 40 is in the generating state (step S22; YES), the process of the flowchart proceeds to the step S34. Then the normal hand movement is conducted, and the current time display is continued (step S34). The process returns to step S22, and the process of the flowchart continues.

[2.2.2] Operation During the Power Saving Mode and During the Transition from the Display Mode to the Power Saving Mode In the display mode, the operations of steps S22 and S34 are repeatedly carried out, but when the non-generation time period lasts more than a prescribed time period, the operation mode is switched from the display mode to the power saving mode. Therefore, at the step S22, when the generation detecting circuit 91 judges that the state of the generating device 40 is in non-generating state (step S22; NO), the non-generation time measuring circuit 84 increases the counted value which is a value counted during the non-generation state (step S23). Next, the mode controller circuit 96 makes a judgment whether or not the counted value by the non-generation time measuring circuit 84 exceeds a prescribed value which corresponds to a prescribed non-generation time (step S24).

When the answer is NO at the step S24, the process of the flowchart goes back to the step S22.

When the answer is YES at the step S24, the non-generation time measuring circuit 84 switches the operation mode from the display mode to the power saving mode, and sends to the time data controller circuit 93 a power saving mode signal that indicates that the operation mode is in the power saving mode (step S25).

In this way, in the second embodiment, it is possible to immediately stop the hands regardless of their location. Therefore, it is possible to reduce the power consumption since it is not necessary to continue to carry out the operation of the apparatus until the hands reach the position of "12:00:00" when switching to the power saving mode.

Next, the circuit 93 makes a judgment if it is a time to start to receive the time data (step S26). At the step S26, when the circuit 93 makes a judgment that it is not a time to start to receive the time data (step S26; NO), the process of the flowchart goes on the step S30.

On the other hand, at the step S26, when the time data controller circuit 93 makes a judgment that it is a time to start to receive the time data (step S26; YES), the charge voltage detecting circuit 92 makes a judgment if the voltage Vss exceeds a lower limit voltage VL by which receiving the time data becomes possible (step S27).

When the judgment of the step S27 is NO, the process goes on to the step S30. When the judgment of the step S27 is YES, the receiver circuit 25 receives the time data through the antenna 26 and sends the time data to the time data controller circuit 93 (step S28). The circuit 93 then adjusts the counted values of the counters 98 and 99 to the current time based on the time data (step S29).

Next, the generation detecting circuit 91 measures the amount of the generation of the generating device 40, and judges if the state of the device 40 is in the generating state (step S30). In the power saving mode, at the step S30, if the circuit 91 judges that the state of the device 40 is in the non-generating state (step S30; NO), the process of the flowchart returns to the step S26. Then during the power saving mode, as shown in the flowchart, when the time comes to receive the time data, the voltage Vss is checked to see if it is high enough to receive the time data. Then when the voltage Vss is high enough, receiving the time data is conducted (step S28), and the time counter is adjusted to the current time (step S29). These operations are carried out repeatedly until the transition to the display mode.

[2.2.3] Operation During the Transition from the Power Saving Mode to the Display Mode The transition from the power saving mode to the display mode is carried out when a prescribed generation is occurring. Therefore, when the transition from the power saving mode to the display mode is carried out, the generation detecting circuit 91 makes a judgment that the generating device 40 is in the generating state (step S30; YES). As a result, the time data controller circuit 93 starts an operation of switching the operation mode from the power saving mode to the display mode.

In a more concrete explanation of the transition to the display mode, first, the second hand location element KS, the minute hand location element KM, and the hour hand location element KH detect the magnetic substance placed on the cogs of the second wheel 52', the center wheel 73', and the hour wheel 75', and locate the second hand, minute hand, and hour hand. Then the counter values that correspond to the locations of the hands are set to the second location counter 82 and the hour-and-minute counter 86 (step S31).

As a result, the locations of the hands before performing a current time display are related to the counter values of the hour-and-minute location counter 86 and second hand location counter 82. Then the counter values of the location counters 86 and 82 will be matched to the counted values of the second time counter 98 and the hour-and-minute time counter 99. As a result, the hands can display the current time.

Next, the second hand, the minute hand, and the hour hand will be moved to display the current time (step S32).

In more concrete explanation of the operation of the current time display, the second counter circuit 94 counts the number of fast-forward pulses supplied from the drive controller circuit 24 to the second drive circuit 30S with the second location counter 82. When the counter value of the second location counter 82 matches the counted value of the second time counter 98, the second matching detecting circuit 85 generates a control signal to stop sending fast-forward pulses. By supplying the control signal to the second drive circuit 30S, the second hand is adjusted to the current time (steps S32 and S33).

Similarly, the hour-and-minute counter circuit 95 counts the fast-forward pulses supplied from the drive controller circuit 24 to the hour-and-minute drive circuit 30HM by using the hour-and-minute location counter 86. When the counted value of the hour-and-minute location counter 86 matches the counted values of the hour-and-minute time counter 99, the hour-and-minute matching detecting circuit 87 generates a control signal to stop sending fast-forward pulses. By supplying the control signal to the hour-and-minute drive circuit 30HM, the hour hand and the minute hand are adjusted to the current time (step S32 and S33).

In this explanation, when switching to the display mode, the second hand is adjusted first, and then other hands are adjusted. However, this order is not so limited. The hour hand and the minute hand can be adjusted first. Or, the hour hand, the minute hand, and the second hand can be adjusted simultaneously. After the transition to the display mode that displays the current time, the normal hand movement is carried out and displaying the current time is continued (step S34).

[2.3] Modifications of the Second Embodiment

In the second embodiment, in order to locate the hand locations, the second hand location element KS, the minute hand location element KM, and the hour hand location element KH are used as magnetic sensors. However, in addition, it is possible to use one or more optical sensor assembled near the gear trains for hand drive. Or, it is also possible to identify the hand location by using an electrical contact or other similar mechanism.

To be more specific, placing a prescribed black and white pattern on the gear wheel, and reading the pattern using a photo transmitter/receiver unit can identify the hand locations. Also placing a prescribed conductive and non-conductive pattern on the gear wheel, and reading the pattern with continuity check can identify the hand locations.

[2.4] Effect of the Second Embodiment

As explained above, in the second embodiment of the present invention, even in the power saving mode, time data is periodically received and used to update the counted values of the hour-and-minute location counter 86 and the second location counter 82 when switching to the display mode. So without receiving the time data again when switching from the power saving mode to the display mode, correct current time can be obtained.

When switching from the power saving mode to the display mode, the second hand location element KS, the minute hand location element KM, and the hour hand location element KH identify the locations of the hands, and the counter values corresponding to them are set into the second location counter 82 and the hour-and-minute location counter 86. Then the current time display is performed by advancing these the set values until they match the current time. Therefore, it is possible to obtain a correct time display. Also when switching to the power saving mode, the hands are immediately stopped, so the power consumption is further reduced.

[3] Third Embodiment

Figure 11:
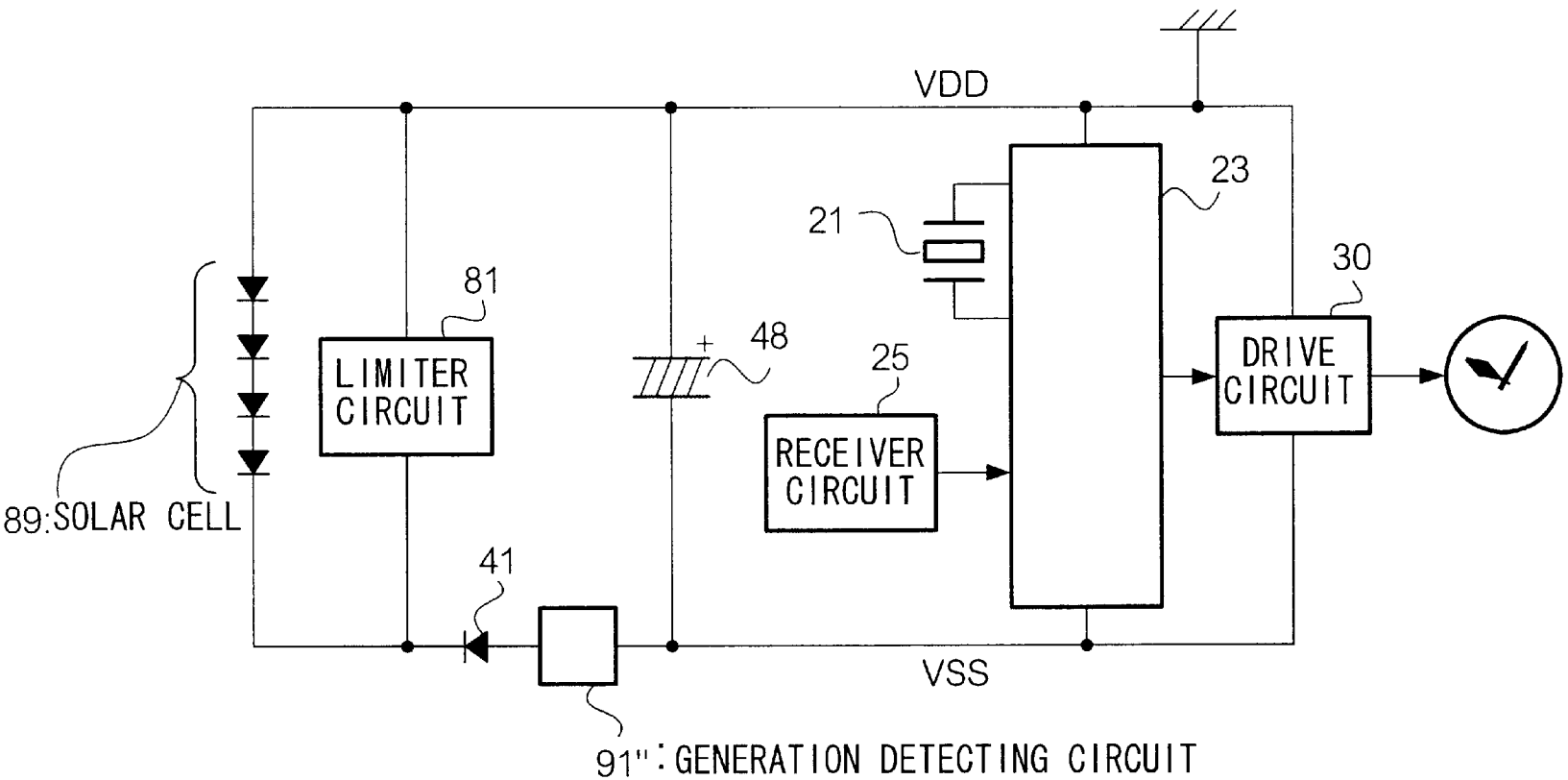
FIG. 11 shows a schematic configuration of a time keeping apparatus of the third embodiment of the present invention.

In the third embodiment of the present invention, a solar cell is used for the power generation unit A. In FIG. 11, a schematic configuration of a time keeping apparatus of the third embodiment of the present invention is shown. In FIG. 11, each part identical to that in FIG. 1 has the same symbol as in FIG. 1, so its detailed explanation is omitted. The time keeping apparatus of the third embodiment of the present invention comprises a standard oscillation source 21, a controller circuit 23, a receiver circuit 25, a drive circuit 30, a countercurrent prevention diode 41, a large capacitance capacitor (battery or storage unit) 48, a limiter circuit 81, a solar cell 89, and a generation detecting circuit 91". The solar cell 89 converts light energy into electric energy. The countercurrent prevention diode 41 is used to prevent the stored charge in the storage unit 48 from flowing back.

Figure 12:
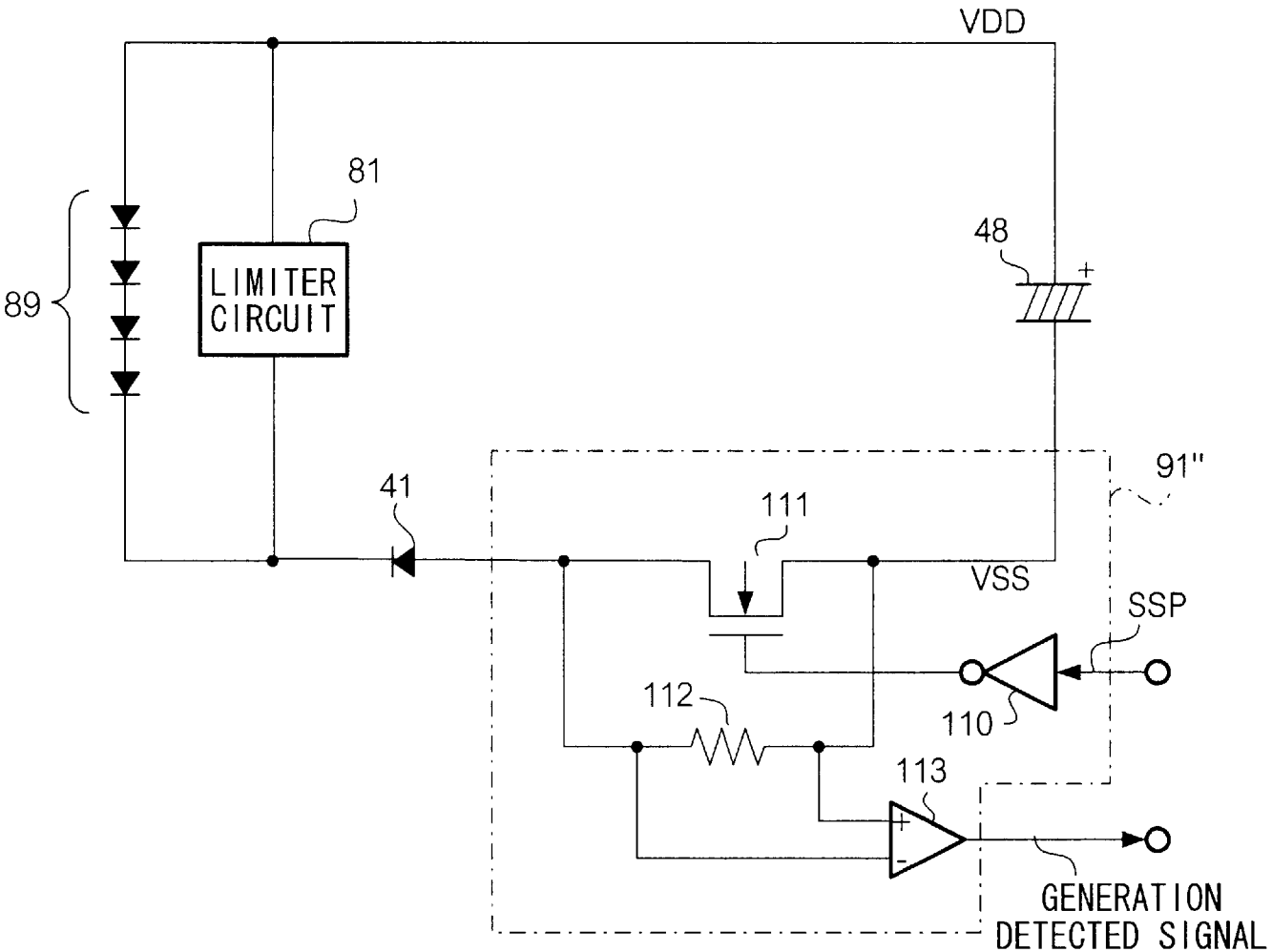
FIG. 12 shows a schematic configuration of a generation detecting circuit of the third embodiment of the present invention.

With reference to FIG. 12, operation of the generation detecting circuit 91" will be described. A sampling signal SSP supplied from the controller unit C intermittently goes to the high level. Thus, an output signal of an inverter 110 intermittently goes to the low level, an n-channel transistor 111 intermittently goes to the OFF state and the generation detecting circuit 91" intermittently goes to a generation detected state. The reason that the generation detecting circuit 91" intermittently goes to a generation detected state is that in the third embodiment, generation is continuously occurring. Therefore, in the non-generation detected state where the n-channel transistor 111 is in the ON state, when the solar cell 89 converts light energy to electrical energy, the storage unit 48 is charged via the n-channel transistor 111.

Also in the generation detected state where the n-channel transistor 111 is in the OFF state, when a voltage drop between the terminals of the resistor 112 is determined to be more than a prescribed value by a detecting comparator 113, the generation detected signal becomes the generation detected state that means the solar cell is converting light energy to electrical energy. In this case, it is possible to apply voltage between the non-inverting terminal and the inverting terminal of the comparator 113, and detection sensitivity can be adjustable.

By this configuration, in a case when the generator can continuously generate electricity as by solar cell 89, it is possible to detect generation more securely, and to effect a more natural mode transition for the user.

[4] Fourth Embodiment

In the first and the second embodiments, the generator is an electromagnetic induction type generator and can produce a relatively large electromotive force. In the third embodiment, the generator is a solar cell. However, in the forth embodiment of the present invention, the generator unit comprises a generator such as thermoelectric generator which produce a relatively small electromotive force. In the fourth embodiment, charging the storage unit is conducted after boosting the voltage with a booster circuit in a subsequent stage. The booster circuit is also used to produce voltage for writing to non-volatile memory. This non-volatile memory stores information necessary to resume time display. For example, the second modification of the first embodiment uses the non-volatile memory in this way.

Figure 13:
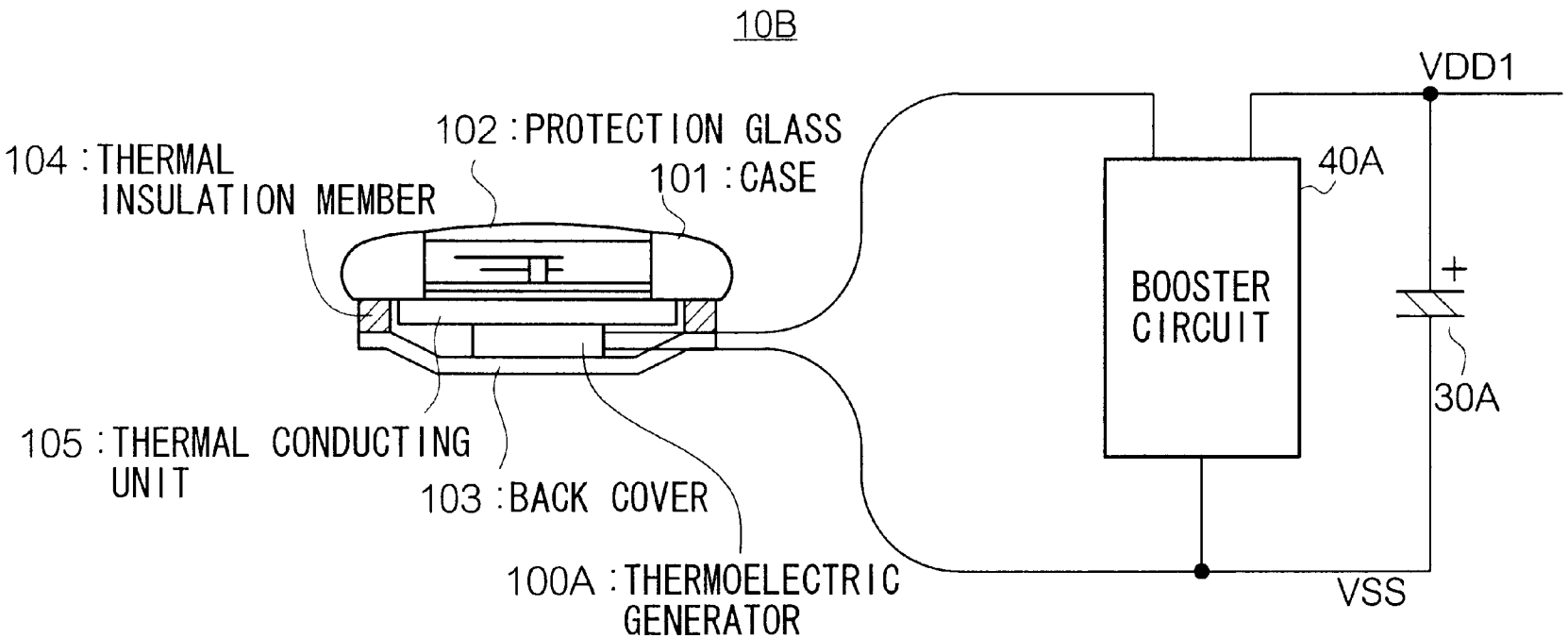
FIG. 13 shows a schematic configuration of a time keeping apparatus of the fourth embodiment of the present invention.

[4.1] Schematic Configuration of an Electric Analog Watch of th Fourth Embodiment FIG. 13 is a schematic configuration of an analog electrical timepiece using a thermoelectric device. An analog electrical timepiece 10B comprises a thermoelectric generator 100A, a case 101, a protection glass 102, a back cover 103, a thermal insulation member 104, and a thermal conducting unit 105. The thermoelectric generator 100A generates electricity by using a temperature difference. The case 101 contains mechanical units. The protection glass 102 protects the hands. The back cover 103 cooperates with the case 101 to contain mechanical units. The thermal insulation member 104 prevents heat from conducting between the case 101 and the back cover 103. The thermal conducting unit 105 conducts heat quickly from the back cover 103 to the case 101, and produces a thermal gradient between the back cover 103 side of the thermoelectric generator 100A and the case 101 side of the thermoelectric generator 100A. The thermoelectric generator 100A is connected to a high capacitance capacitor 30A via a booster circuit 40A that is placed at subsequent stage.

Next, an outline of the operation of the analog electrical timepiece with thermal generating device will be described. When the user wears the analog electrical timepiece 10B, the heat of the user moves to the back cover 103, and the temperature at the back cover side of the thermoelectric generator 100A rises.

On the other hand, heat at the case side of the thermoelectric generator 100A is released to the atmosphere via the thermal conducting unit 105 and the case 101. So, a thermal gradient is produced between the back cover 103 side of the thermoelectric generator 100A and the case 101 side of the thermoelectric generator 100A. As a result, the thermoelectric generator 100A generates electricity. The voltage at the generator 100A is usually from 0.4 to 0.5 volts when the user carries the apparatus.

Then, the voltage at the thermoelectric generator 100A is boosted from three to eight times, since the operating voltage of the apparatus is around from 1.4 to 3 volts. Then the boosted voltage becomes a storage unit voltage VDD1, and is stored in the high capacitance capacitor 30A.

[4.2] Effect of the Fourth Embodiment

As explained above, according to the fourth embodiment of the present invention, it is possible to use the booster circuit 40A as a power source for other circuits. In this case, the booster circuit 40A is also used to produce the voltage for writing to non-volatile memory. In the fourth embodiment, the booster circuit 40A boosts the voltage generated by the thermoelectric generator and generates a power supply voltage for the analog electrical timepiece.

Therefore, if there is a circuit that requires high voltage, it is possible to make the circuit size smaller by reducing the number of boosting stages. Hence it is possible to make the size of IC chip smaller and to reduce the cost of the apparatus.

[5] Fifth Embodiment

[5.1] Configuration of the Fifth Embodiment

Figure 14:
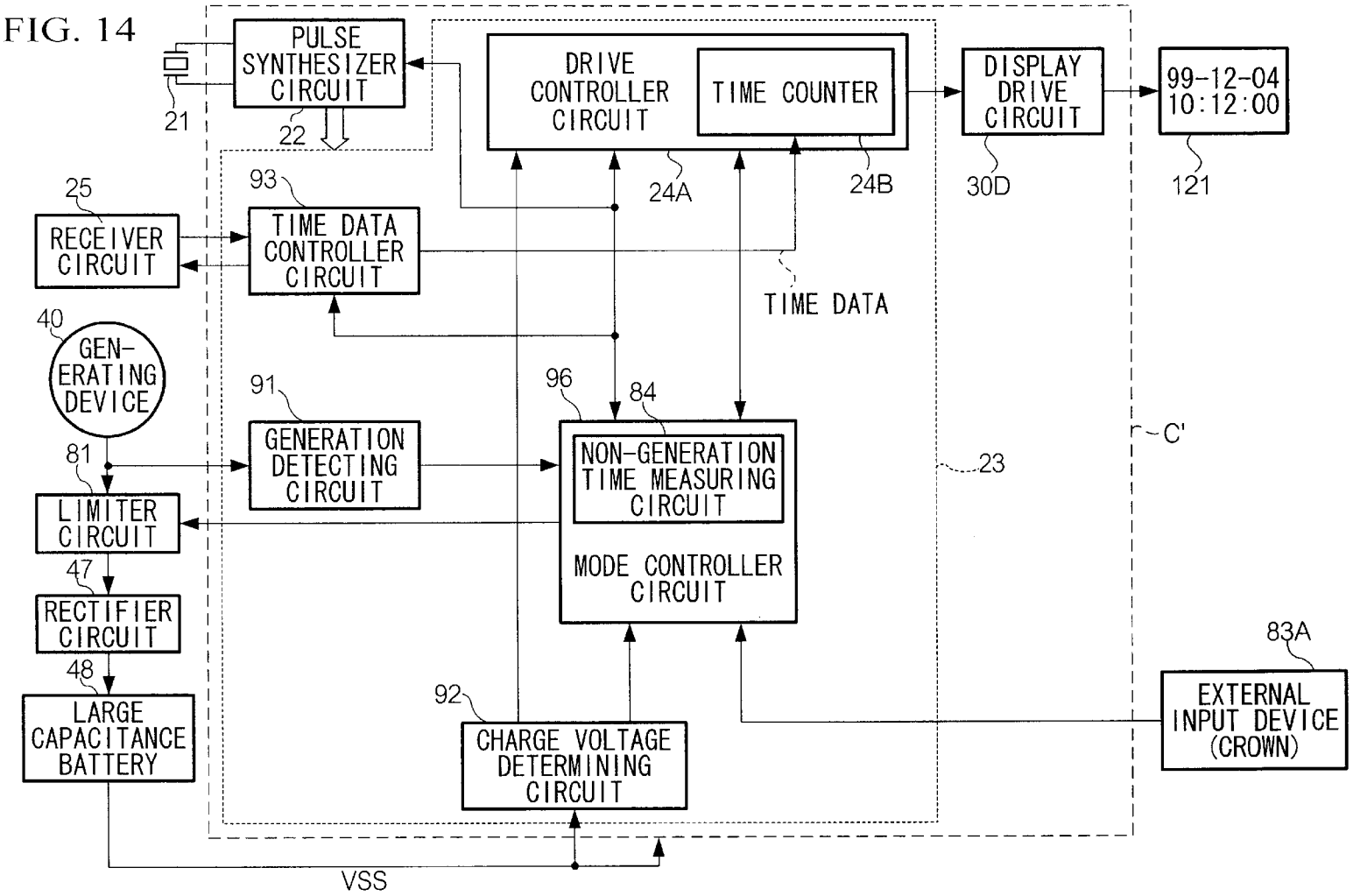
FIG. 14 is a block diagram showing an outlined configuration of a controller unit of the fifth embodiment of the present invention.

With reference to the drawings, the fifth embodiment of the present embodiment will be described. FIG. 14 is a functional block diagram showing a configuration of a controller unit C' and associated circuitry of the fifth embodiment of the present invention. In FIG. 14, each part identical to that in FIG. 2 has the same symbol as in FIG. 2, and so its detailed explanation is omitted.

In the above embodiments, explanation is given for an analog timepiece.

However, in the fifth embodiment, the present invention is applied to a digital timepiece.

The controller unit C' comprises a pulse synthesizer circuit 22, a drive controller circuit 24A, a generation detecting circuit 91, a charge voltage determining circuit 92, a mode controller circuit 96, and a time data controller circuit 93.

The drive controller circuit 24A comprises a time counter 24B. The time counter 24B counts time that is to be displayed on a display 121. The display 121 is connected to the time counter 24B via a display drive circuit 30D. For display 121, a liquid crystal display (LCD), an organic electroluminescence (EL) display, or a light emitting diode (LED) display will be used. The mode controller circuit 96 is connected to a switch 83A that functions as an external input device.

Next, operations of substantial parts of the fifth embodiment will be described. In the display mode, the mode controller circuit 96 brings the display drive circuit 30D to an operation state. The drive controller circuit 24A receives an output of the pulse synthesizer circuit 22 causing the time counter 24B to count the current time.

Then, the display drive circuit 30D performs a time display on the display 121 based on the counted value of the time counter 24B.

When switching from the display mode to the power saving mode, the mode controller circuit 96 brings the display drive circuit 30D to a non-operation state, causing the display 121 to stop time display.

Further, when switching from the power saving mode to the display mode, under control of the mode controller circuit 96, the time data controller circuit 93 receives, via the receiver circuit 25, time data that corresponds to the current time at the moment of the transition from the power saving mode to the display mode. Then the circuit 96 sets the time data in the time counter 24B. Also the circuit 96 brings the display drive circuit 30D to an operation state. As a result, the drive controller circuit 24A receives an output of the pulse synthesizer circuit 22 and the time counter 24B resumes counting of the current time. Then the display drive circuit 30D resumes performing time display on the display 121 based on the counted value of the time counter 24B.

[5.2] Effect of the Fifth Embodiment

As explained above, according to the fifth embodiment of the present invention, during the power saving mode, time display is stopped and therefore the power consumption is reduced, and during the transition from the power saving mode to the display mode, time data is received and current time display is correctly performed.

[6] Variations

[6.1] First Variation

In the above embodiments, the generation detecting circuit 91 is used. However a generation detecting circuit 91' shown in FIG. 8 can be used instead.

Figure 8:
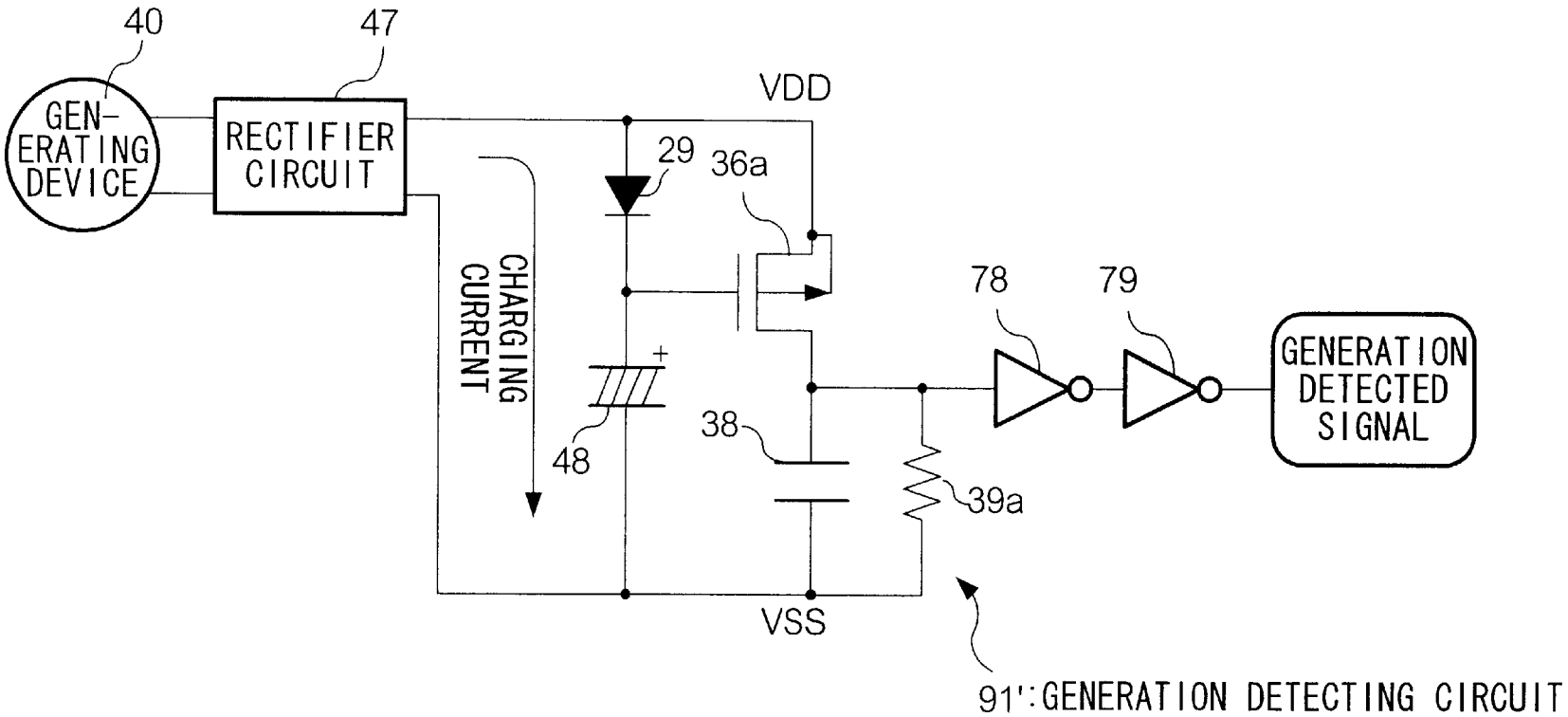
FIG. 8 is a block diagram showing a modification of the generation detecting circuit.

A detailed configuration of the generation detecting circuit 91' will be described by referring to FIG. 8. The generation detecting circuit 91' comprises a diode 29, a transistor 36*a*, a capacitor 38, a pull-down resistor 39*a*, an inverter 78, and an inverter 79. The diode 29 is placed between the positive terminal of the storage unit 48 and the higher electric potential side voltage Vdd. One terminal of the capacitor 38 is connected to the drain terminal of the transistors 36*a*. The other terminal of the capacitor 38 is connected to the lower electric potential side voltage Vss. The resistor 39*a* is connected in parallel with the capacitor 38 and is used for discharging the charge in the capacitor 38. One terminal of the resistor 39*a* is connected to the lower electric potential side voltage Vss. The inverter 78 is connected to the drain terminal of the transistor 36*a*. The inverter 79 is connected in series to the inverter 78, and the output signal of the inverter 79 is a detected generation signal.

Also it is possible to use a resistor instead of the diode 29. In this case, it is preferable to use a resistor that has a resistance of several hundred ohms.

In the above configuration, when voltage is induced in the generating device 40, charging current flows from the rectifier circuit 47 to the storage unit 48 via the diode 29. So, between the cathode and the anode of the diode 29, a forward voltage Vf appears. When the forward voltage exceeds a threshold voltage Vth of the transistor 36*a*, the transistor 36*a* turns ON. Then, a potential difference appears between the terminals of the capacitor 38. Since the input to the inverter 78 goes to the high level, the detected generation signal output from the inverter 79 goes to the high level. On the other hand, when no voltage is induced in the generating device 40, the transistor 36*a* remains OFF. So, the charge in the capacitor 38 is discharged by the pull-down resistor 39*a*. Then, the voltage between the terminals of the capacitor 38 declines. Therefore, the input to the inverter 78 goes to the low level, and the detected generation signal output from the inverter 79 goes to the low level.

Hence, when no voltage is induced in the generating device 40, it is possible to reduce the power consumption to zero in the generation detecting circuit 91'.

[6.2] Second Variation

Figure 15:
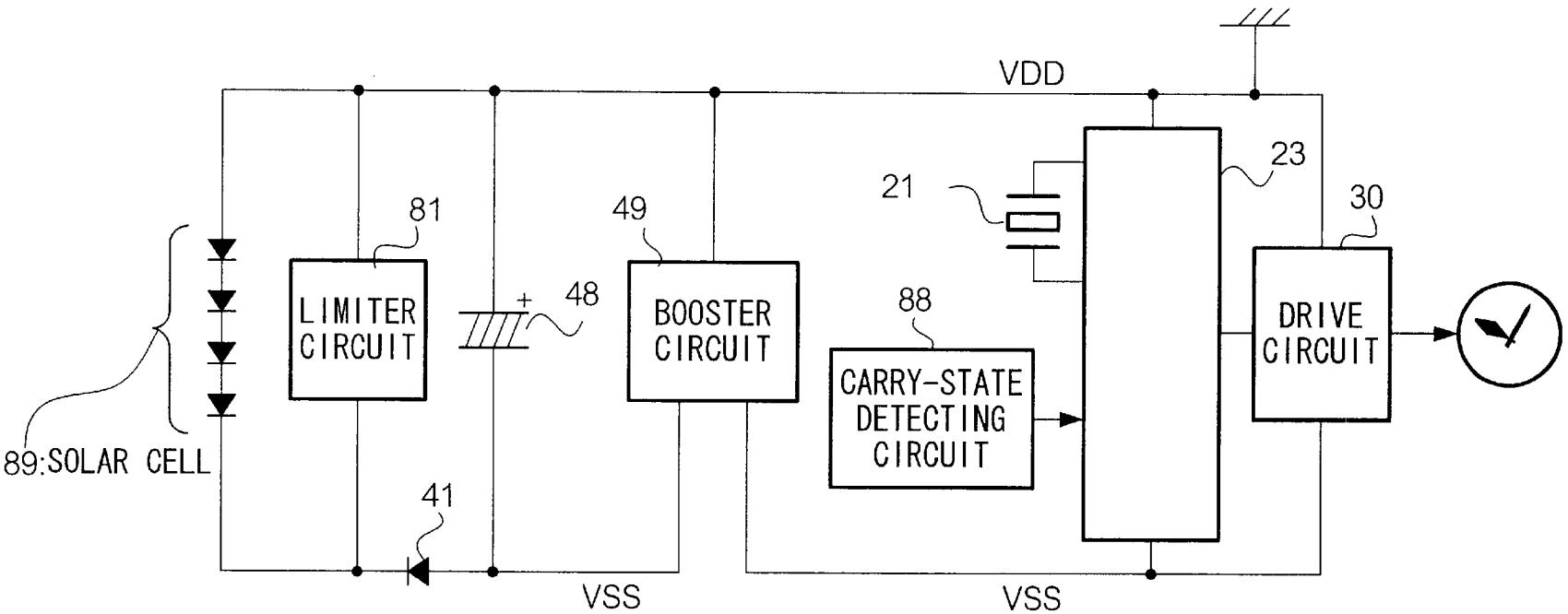
FIG. 15 is a block diagram showing a modification of the time keeping apparatus with a carry-state detecting circuit.

The above embodiments include the generation detecting circuit 91. However instead of the circuit 91, a carry-state detecting circuit 88 (FIG. 15) can be used. The carry-state detecting circuit 88 detects a state of carrying of the time keeping apparatus (i.e. whether or not the apparatus is being carried by a user), and with this detection effects mode transition between the power saving mode and the display mode. For example, in the flowchart in FIG. 3, a judgment whether or not the user carries the apparatus is performed based on a signal detected by the circuit 88 in step S2. Also using the carry-state detecting circuit 88 has other advantages. One of them is that when the circuit 88 is used with the solar cell 89, the mode transition becomes more natural to the user. This is because even in darkness the mode does not change to the power saving mode because the time keeping apparatus is still being carried. This is also because when the user stops carrying the apparatus, the apparatus stops displaying time and enters the power saving mode. For the carry-state circuit 88, an acceleration sensor for measuring acceleration produced when the apparatus is carried, a measuring instrument for measuring a change in inter-electrode resistance or inter-electrode capacitance when the apparatus is carried, or a piezoelectric element can be used.

The countercurrent prevention diode 41 is used to prevent the stored charge in the storage unit 48 from flowing back.

In the second variation, when the carry-state circuit 88 detects a state of non-carrying, the operation mode is switched to the power saving mode and the power consumption can be reduced further.

[6.3] Third Variation

In the above embodiments, the receiver circuit 25 periodically receives the time data. However it is possible to use a configuration in which when the operation mode is switched from the display mode to the power saving mode, transition to the power saving mode is carried out after the receiving operation is conducted. Thus, when the receiving operation is not conducted during the power saving mode and the operation mode is switched from the power saving mode to the display mode, it is possible to perform a time display correctly.

[6.4] Fourth Variation

In the above embodiments, an electromagnetic induction type generator is used for the generator 40. However, other generation devices, for example, solar cell, thermoelectric element, or piezo-electric device can be used. Also it is possible to use more than two kinds of these generation devices in the generator 40.

[6.5] Fifth Variation

In the above embodiments, the rectifier circuit 47 can be a half-wave rectifier circuit or a full-wave rectifier circuit. Also the circuit 47 can be configured with diodes or active elements.

[6.6] Sixth Variation

In the above embodiments, as motors for driving the hands, the hour-and-minute motor for the hour hand and the minute hand, and the second motor for the second hand are used. However, a configuration for the apparatus is not limited to this. For example, instead of using two motors, it is possible to use one motor that moves all three hands. Or, it is also possible to use three motors, one for each of these three hands. Also it is possible use liquid crystal display (LCD) for second display and a motor for the hour hand and the minute hand. Also, all the displays for time and calendar can use an LCD.

[6.7] Seventh Variation

In the above embodiments, as an antenna for receiving the standard time radio wave, the ferrite rod antenna 26 is used. However when receiving FM radio wave with a frequency from 76 MHz to 108 MHz in which a time data is superimposed, it is possible to use a loop antenna or a ferrite rod antenna. Also when receiving a radio wave with a frequency of 1.5 GHz coming from the satellites for the Global Positioning system (GPS) in which a time data is superimposed, it is possible to use a microstrip antenna or a helical antenna.

As a radio wave in which a time data is superimposed, the standard time radio wave from the CRL Japan is used in the above embodiments. However, instead of using the radio wave from the CRL Japan, it is possible to use other signals such as the GPS signals, pager signals used in FLEX-TD pager system, FM multiplexed signal in which a time data is superimposed, and signals transmitted from the base stations to the digital mobile phone in the CDMA communications system.

[6.8] Eighth Variation

In the above embodiments, the large resistance resistor 39 is used to discharge the charge in the capacitor 38 in the generation detecting circuit 91.

However, the resistor 39 is replaceable with a small constant current source having a capacity of several nano amperes.

[6.9] Ninth Variation

In the above embodiments, based on the standard time radio wave in which a time information is superimposed, the time display of hour, minute, and second is automatically adjusted. However, in addition to these time displays, calendar display can be adjusted automatically. As explained above, the standard time radio wave has date information in it. So, by adding a motor for the calendar, in addition to the motors for driving the second hands, the minute hand, and the hour hand, calendar display can be adjusted automatically. In this case, it is also possible to add a calendar display location element.

[7] Control Method of the Embodiments of the Present Invention

To sum up the control method of the embodiments of the present invention, in a method for controlling a time keeping apparatus which comprises a generator unit for generating electricity by converting external energy to electrical energy and a time display unit for performing a time display, the method carries out detecting a state of generation of the generator unit, outputting a detected generation state signal, switching an operation mode of the time display unit between a normal operation mode in which the time display is performed based on the detected generation state signal and a power saving mode in which the time display is stopped, a receiving step for receiving a time information from outside of the apparatus (i.e. external) in a predetermined cycle during the power saving mode, renewing a current time information which corresponds to the current time by referring to the time information received by the receiver unit and switching a state of the time display unit from a time display stoppage state to a current time display state in which a current time is displayed based on the current time information when the operation mode is switched from the power saving mode to the normal operation mode. In this case, when the state of the generator unit is detected to be in a non-generation state on the basis of the detected generation state signal, the operation mode is switched from the normal operation mode to the power saving mode.

The cycle of receiving the time information may be longer in the power saving mode than in the normal operation mode.

The receiver unit may receive the time information when the operation mode is switched from the normal operation mode to the power saving mode.

When the detected generation state signal has indicated that the generator unit has not been generating for more than a prescribed time period, a state of the generator unit may be identified as in the non-generation state.

The time display unit comprises a hand for displaying time, and the hand is not driven during the power saving mode and, the hands are driven to a location corresponding to the current time when switching to the current time display state.

When switching the operation mode from the normal operation mode to the power saving mode, the hands are moved to a prescribed location and then the operation mode is switched to the power saving mode. When switching to the current time display state, the hands are driven from the prescribed location to a location corresponding to the current time.

A counted value which corresponds to the number of drive pulses generated for driving the hand is output and the counted value is stored when the operation mode is switched from the normal operation mode to the power saving mode. The switching operation to the current time display state is controlled based on the counted value.

The hand locations can be identified when switching to the power save mode, and the hands are driven to a location corresponding to the current time from the identified hand locations when switching to the current time display state.

A state of generation is detected based on generated voltage by the generator unit.

A storage unit voltage of the storage unit is determined, and receiving the time information is stopped when the storage unit voltage is lower than a prescribed voltage and the operation mode is in the power saving mode. Here, the prescribed voltage is set high enough for completion of the receiving operation of the time information.

Detection of whether or not the time keeping apparatus is in a carry-state can be made based on the state of generation. Electricity is generated using external energy and is stored. A time display is performed by using the electricity. Detection of a carry-state of the time keeping apparatus is made. A switch is performed in an operation mode of the time display unit between a normal operation mode in which the time display is performed and a power saving mode in which the time display is stopped. Receiving a time information from outside in a prescribed cycle carried out. Renewal or update of a current time information is conducted by referring to the time which corresponds to the time information received. When the operation mode is switched from the power saving mode to the normal operation mode, based on the current time information, a switch is conducted of the state of the time display unit from a time display stoppage state to a current time display state in which a current time is displayed. In this case, when a prescribed non-carry-state is detected, the operation mode is switched from the normal operation mode to the power saving mode.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A time keeping apparatus comprising:

a generator unit that generates electricity using external energy;

a storage unit that stores the electricity;

a time display unit that displays time by using the electricity supplied from the storage unit;

a generation state detecting unit that detects an operation state of the generator unit and that outputs a detected generation state signal;

a mode switching unit that, responsive to the detected generation state signal, switches an operation mode of the time display unit between a normal operation mode in which the time display operation is performed and a power saving mode in which the time display operation is stopped;

a receiver unit for receiving external time information in a prescribed cycle;

a current time counting unit that updates current time information by referring to the time that corresponds to the time information received by the receiver unit; and, a current time display switching unit that is responsive to the operation mode switching from the power saving mode to the normal operation mode to switch a state of the time display unit from a time display stoppage state to a current time display state in which a current time is displayed, based on the current time information;

wherein the mode switching unit is responsive to the detected generation state signal to switch the operation mode from the normal operation mode to the power saving mode when the state of the generator unit is detected to be in a non-generation state.

2. A time keeping apparatus of claim 1, wherein the cycle of receiving the time information is longer in the power saving mode than in the normal operation mode.

3. A time keeping apparatus of claim 1, wherein the receiver unit receives the time information when the operation mode is switched from the normal operation mode to the power saving mode.

4. A time keeping apparatus of claim 1, wherein when the detected generation state signal has indicated that the generator unit has not been generating for more than a prescribed time period, the mode switching unit determines a state of the generator unit as in the non-generation state.

5. A time keeping apparatus of claim 1, wherein the time display unit comprises at least one hand for displaying time; and wherein the at least one hand is not driven during the power saving mode; and, the current time display switching unit drives the at least one hand to a location corresponding to the current time when switching to the current time display state.

6. A time keeping apparatus of claim 5, wherein the at least one hand moves to a prescribed location before the mode switching unit switches the operation mode from the normal operation mode to the power saving mode; and, the current time display switching unit drives the hands from the prescribed location to a location corresponding to the current time when switching to the current time display state.

7. A time keeping apparatus of claim 5, further comprising:

a hand location counter that outputs a counted value that corresponds to the number of drive pulses generated for driving the at least one hand; and, a nonvolatile memory for storing the counted value when the operation mode is switched from the normal operation mode to the power saving mode; and wherein the current time display switch unit controls switching operation to the current time display state based on the counted value.

8. A time keeping apparatus of claim 5, further comprising a hand location determination unit for determining the at least one hand location; and wherein the current time display switching unit drives the at least one hand to a location corresponding to the current time from the hand location determined by the hand location determination unit when switching to the current time display state.

9. A time keeping apparatus of claim 1, wherein the generator unit comprises a solar cell.

10. A time keeping apparatus of claim 9, further comprising a voltage determining unit that determines a storage voltage of the storage unit, and wherein the receiver unit stops receiving the time information when the storage voltage is lower than a prescribed voltage and the operation mode is in the power saving mode.

11. A time keeping apparatus of claim 10, wherein the prescribed voltage is set to a value such that the receiver unit can complete receiving the time information.

12. A time keeping apparatus of claim 9, further comprising a carry-state detecting circuit for detecting whether or not the apparatus is in a carry-state.

13. A time keeping apparatus of claim 1, wherein the generator unit comprises an oscillating weight and a rotor, and that generates electricity by using rotation of the rotor that is driven by movement of the oscillating weight.

14. A time keeping apparatus of claim 13, wherein the generation state detecting unit detects a state of generation based on voltage generated by the generator unit.

15. A time keeping apparatus of claim 1, wherein the generator unit comprises a thermoelectric generator that generates electricity by using external thermal energy.

16. A time keeping apparatus comprising:

a generator unit that generates electricity using external energy;

a storage unit that stores the electricity;

a time display unit that displays time by using the electricity supplied from the storage unit;

a carry-state detecting unit that detects a carry-state of the time keeping apparatus and that outputs a detected carry-state signal;

a mode switching unit that, responsive to the detected carry-state signal, switches an operation mode of the time display unit between a normal operation mode in which the time display operation is performed and a power saving mode in which the time display operation is stopped;

a receiver unit that receives external time information in a prescribed cycle;

a current time counting unit for updating current time information by referring to the time which corresponds to the time information received by the receiver unit; and, current time display switching unit that is responsive to the operation mode switching from the power saving mode to the normal operation mode to switch a state of the time display unit from a time display stoppage state to a current time display state in which a current time is displayed, based on the current time information; and wherein the mode switching unit is responsive to the detected carry-state signal to switch the operation mode from the normal operation mode to the power saving mode when the carry-state of the time keeping apparatus is detected to be in a non-carried state.

17. A method for controlling a time keeping apparatus that comprises a generator unit that generates electricity by converting external energy to electrical energy and a time display unit that performs a time display, the method comprising:

detecting an operation state of the generator unit and outputting a detected generation state signal;

in response to the detected generation state signal, switching an operation mode of the time display unit between a normal operation mode in which the time display is performed and a power saving mode in which the time display is stopped;

receiving external time information in a predetermined cycle during the power saving mode;

updating a current time information that corresponds to the current time by referring to the received external time information; and, when the operation mode is switched from the power saving mode to the normal operation mode, switching a state of the time display unit from a time display stoppage state to a current time display state in which a current time is displayed, based on the current time information;

responsive to the detected generation state signal, switching the operation mode from the normal operation mode to the power saving mode when the state of the generator unit is detected to be in a non-generation state.

* * * * *